US005286616A

United States Patent [19]

Sakai et al.

[11] Patent Number: 5,286,616

[45] Date of Patent: Feb. 15, 1994

[54] SILVER HALIDE PHOTOGRAPHIC MATERIAL

[75] Inventors: Nobuo Sakai; Fuyuhiko Mori, both of Kanagawa, Japan

[73] Assignee: Fuji Photo Film Co., Ltd., Kanagawa, Japan

[21] Appl. No.: 983,291

[22] Filed: Nov. 30, 1992

Related U.S. Application Data

[63] Continuation of Ser. No. 206,057, Jun. 13, 1988, abandoned.

[30] Foreign Application Priority Data

Jun. 12, 1987 [JP] Japan ..... 62-146630

[51] Int. Cl.[5] ..... G03C 1/38; G03C 7/36; G03C 7/388; G03C 1/815

[52] U.S. Cl. ..... 430/505; 430/507; 430/512; 430/546; 430/557; 430/531

[58] Field of Search ..... 430/507, 512, 505, 546, 430/557, 931

[56] References Cited

U.S. PATENT DOCUMENTS

| | | | |
|---|---|---|---|
| 3,936,303 | 2/1976 | Shiba et al. | 430/546 |
| 4,540,656 | 9/1985 | Nishizima et al. | 430/505 |
| 4,587,208 | 5/1986 | Kadowaki et al. | 430/507 |
| 4,668,611 | 5/1987 | Nakamura | 430/507 |
| 4,745,047 | 5/1988 | Asami et al. | 430/376 |
| 4,774,168 | 9/1988 | Ogawa et al. | 430/383 |
| 4,783,394 | 11/1988 | Hirose et al. | 430/931 |
| 4,791,050 | 12/1988 | Ogawa et al. | 430/506 |
| 4,818,673 | 4/1989 | Ueda et al. | 430/566 |
| 4,830,956 | 5/1989 | Waki | 430/558 |

FOREIGN PATENT DOCUMENTS

| | | |
|---|---|---|
| 0213700 | 7/1986 | European Pat. Off. . |
| 0231870 | 1/1987 | European Pat. Off. . |
| 0232770 | 1/1987 | European Pat. Off. . |

*Primary Examiner*—Lee C. Wright

*Attorney, Agent, or Firm*—Sughrue, Mion, Zinn, Macpeak & Seas

[57] ABSTRACT

A silver halide color photographic material comprising a reflective support having provided therein a blue-sensitive silver halide emulsion layer, a green-sensitive silver halide emulsion layer, a red-sensitive silver halide emulsion layer and plural light-insensitive layers, wherein the blue-sensitive silver halide emulsion layer contains a monodisperse silver halide emulsion and a yellow coupler represented by formula (I) defined below, and at least one light-insensitive layer which is positioned farther from the reflective support than the blue-sensitive silver halide emulsion layer is a hydrophilic colloid layer containing at least one hydrophobic compound represented by formula (II) defined below, and a relative refractive index of an organic phase containing the hydrophobic compound with the exception of a volatile organic solvent and an amphipathic solute to a hydrophilic polymer thin film which forms the light-insensitive layer is in a range from 0.9875 to 1.0125; wherein said yellow coupler is represented by formula (I)

(I)

wherein $R_1$ represents a halogen atom or an alkoxy group; $R_2$ represents a hydrogen atom, a halogen atom, or an alkoxy group; A represents $-NHCOR_3$, $-NHSO_2R_3$, $-SO_2NHR_3$, $-COOR_3$ or each represents an alkyl group; and Y represents a group which is capable of being released upon a coupling reaction with an oxidation product of a developing agent and is connected to the coupling position through an oxygen atom or a nitrogen atom; and wherein said hydrophobic compound is represented by formula (II)

(Abstract continued on next page.)

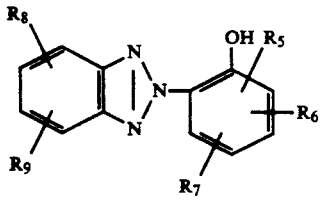

(II)

wherein $R_5$, $R_6$, $R_7$, $R_8$ and $R_9$each represents a hydrogen atom, a halogen atom, a nitro group, a hydroxy group, an alkyl group, an alkenyl group, an aryl group, an alkoxy group, an acyloxy group, an aryloxy group, an alkylthio group, an arylthio group, a mono- or dialkylamino group, an acylamino group or a 5-membered or 6-membered heterocyclic group containing an oxygen atom or a nitrogen atom; or $R_8$ and $R_9$ are connected together to form a 5-membered or 6-membered aromatic carbon ring.

The silver halide color photographic material has sufficiently high color forming properties, particularly in the blue-sensitive emulsion layer thereof, is suitable for a rapid processing, and is excellent in processing stability.

17 Claims, No Drawings

SILVER HALIDE PHOTOGRAPHIC MATERIAL

This is a continuation of application Ser. No. 07/206,057, filed Jun. 13, 1988 now abandoned.

FIELD OF THE INVENTION

The present invention relates to a silver halide color photographic material, and more particularly, to a silver halide color photographic material having a sufficiently high color forming property and containing a blue-sensitive emulsion layer having a reduced amount of coating silver, and further to a silver halide color photographic material which is suitable for rapid processing and excellent in processing stability.

BACKGROUND OF THE INVENTION

In silver halide color photographic materials, a light-sensitive layer comprising three kinds of silver halide emulsion layers which have been selectively sensitized so as to have a sensitivity to blue color, green color and red color, respectively is applied in a multilayer construction onto a support. For example, in a so-called color printing paper (hereinafter referred to as "color paper"), a red-sensitive emulsion layer, a green-sensitive emulsion layer, and a blue-sensitive emulsion layer are provided usually in the order stated, from the side from which exposure to light is carried out, and a color mixing-preventing or ultraviolet light-absorptive interlayer or protective layer is provided between the respective light-sensitive layers.

In forming color photographic images, three photographic color couplers of yellow, magenta, and cyan are incorporated in light-sensitive layers and, after exposure to light, the resulting light-sensitive material is subjected to color development processing using a so-called color developing agent. Coupling reaction between an oxidation product of an aromatic primary amine and each coupler provides a colored dye. In such a case, it is required to provide a color density as high as possible within a restricted developing time.

In recent years, it has been requested in this field that after receipt of order, prints obtained by development processing can be promptly delivered to users. Therefore, a silver halide color photographic material which can be rapidly processed and is excellent in processing stability has been desired. In addition, it is naturally requested to provide color prints at a low cost.

With color paper, since the blue-sensitive silver halide emulsion layer is provided on the nearest position to the support as described above, developing speed of the layer is slowest. Accordingly, it is most important to improve developing properties of the blue sensitive silver halide emulsion layer in order to enable rapid processing.

For the purpose of obtaining a high color density, it is ordinarily investigated to employ a coupler having a coupling rate as fast as possible, to employ a silver halide emulsion which is readily developed and provides a large amount of developed silver per unit coating amount, and/or to utilize a color developing solution having a high developing speed.

Various techniques on silver halide color photographic materials capable of being rapidly processed have hitherto been known. For instance, there are (1) a technique to make silver halide grains fine as described in Japanese Patent Application (OPI) No. 77223/76 (the term "OPI" as used herein means an "unexamined published patent application"); (2) a technique to lower silver bromide in silver halide as described in Japanese Patent Application (OPI) No. 184142/83 and Japanese Patent Publication No. 18939/81; (3) a technique of adding a 1-aryl-3-pyrazolidone having the specific structure to a silver halide photographic material as described in Japanese Patent Application (OPI) No. 64339/81 and further a technique of adding a 1-aryl-3-pyrazolidone to a silver halide color photographic material as described in Japanese Patent Application (OPI) Nos. 144547/82, 50534/83, 50535/83 and 50536/83; and (4) a technique of using a color development accelerator, for example, such as those as described in U.S. Pat. Nos. 2,950,970, 2,515,147, 2,496,903, 4,038,075 and 4,119,462, British Patents 1,430,998 and 1,455,413, Japanese Patent Application (OPI) Nos. 15831/78, 62450/80, 62451/80, 62452/80 and 62453/80, Japanese Patent Publication Nos. 12422/76 and 49728/80, etc.

However, when technique (3) or (4) is employed, although the processing time is shortened, processing stability is poor in the rapid processing and a problem of fog occurs. Also, when a low silver bromide emulsion is used in accordance with technique (2), a problem of low processing stability occurs while a rapid processing can be performed. Further, in the case of using fine grain silver halide according to technique (1), the severe disadvantage of decrease in sensitivity is accompanied, in addition to a problem of low processing stability.

Resently, a technique using emulsion grains having an average particle size of 0.20 μm to 0.55 μm as silver halide in the blue-sensitive emulsion layer is proposed as described in Japanese Patent Application (OPI) Nos. 38944/86, 52644/86, 80253/86, 80254/86, 97655/86, 100751/86 and 153639/86, etc. However, there is a problem of remarkable decrease in sensitivity, though improved effects on a rapid processing property and processing stability are recognized.

Moreover, it is preferred to employ a coupler having a high coupling activity for the purpose of imparting a rapid processing property. However, there is a severe problem in that fog increases remarkably as the coupling activity of coupler increases.

SUMMARY OF THE INVENTION

Therefore, an object of the present invention is to provide at a low cost a silver halide color photographic material capable of processing a rapid processing and excellent in processing stability, wherein a blue-sensitive emulsion layer which has been troublesome with respect to rapid processing aptitude has a sufficiently high color forming property and a reduced amount coating silver.

Other objects of the present invention will become apparent from the following description and examples.

As the result of investigations on techniques for improving a color forming property of the blue-sensitive emulsion layer from a different point of view from hitherto known techniques, it has been found that color density in the blue-sensitive emulsion layer is optically decreased due to a multilayer structure of a silver halide color photographic material. Therefore, a technique for preventing the decrease in optical density has been studied and it has been found that an extremely remarkable improving effect can be attained by using monodisperse emulsions in combination.

Specifically, the above described objects of the present invention can be achieved by a silver halide color photographic material comprising a reflective support having provided thereon a blue-sensitive silver halide emulsion layer, a green-sensitive silver halide emulsion layer, a red-sensitive silver halide emulsion layer and plural light-insensitive layers, wherein the blue-sensitive silver halide emulsion layer contains a monodisperse silver halide emulsion and a yellow coupler represented by formula (I) defined below, and at least one light-insensitive layer which is positioned farther from the reflective support than the blue-sensitive silver halide emulsion layer is a hydrophilic colloid layer containing at least one hydrophobic compound represented by formula (II) defined below, and a relative refractive index of an organic phase containing the hydrophobic compound with the exception of a volatile organic solvent and an amphipathic solute to a hydrophilic polymer thin film which forms the light-insensitive layer is in a range from 0.9875 to 1.0125.

The yellow coupler is represented by formula (I)

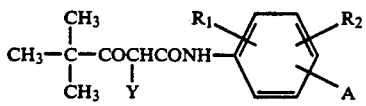

(I)

wherein $R_1$ represents a halogen atom or an alkoxy group; $R_2$ represents a hydrogen atom, a halogen atom or an alkoxy group; A represents $—NHCOR_3$, $—NHSO_2R_3$, $—SO_2NHR_3$, $—COOR_3$ or $$—SO_2\underset{\underset{R_4}{|}}{N}R_3;$$

$R_3$ and $R_4$ (which may be the same or different) each represents an alkyl group; and Y represents a group which is capable of being released upon a coupling reaction with an oxidation product of a developing agent and is connected to the coupling position through an oxygen atom or a nitrogen atom.

The hydrohobid compound is represented by formula (II)

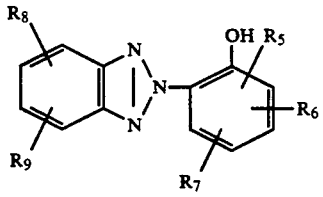

(II)

wherein $R_5$, $R_6$, $R_7$, $R_8$ and $R_9$, which may be the same or different) each represents a hydrogen atom, a halogen atom, a nitro group, a hydroxy group, an alkyl group, an alkenyl group, an aryl group, an alkoxy group, an acyloxy group, an aryloxy group, an alkylthio group, an arylthio group, a mono- or di-alkylamino group, an acylamino group or a 5-membered or 6-membered heterocyclic group containing an oxygen atom or a nitrogen atom; or $R_8$ and $R_9$ may be connected with each other to form a 5-membered or 6-membered aromatic carbon ring.

DETAILED DESCRIPTION OF THE INVENTION

In the monodisperse silver halide emulsion used in the blue-sensitive silver halide emulsion layer according to the present invention, the average particle size of silver halide grains is preferably from 0.2 μm to 2 μm, more preferably from 0.55 μm to 1.3 μm defined as a diameter of a circle having an area equal to the projected area of the grain. Further, the grain size distribution which represents a degree of monodispersibility is preferably not more than 0.2, more preferably not more than 0.15 in terms of a coefficient of variation, i.e., a ratio ($S/\bar{d}$) of a statistical standard deviation (S) to an average particle size ($\bar{d}$).

Grain size and coefficient variation are measured according to a method disclosed in T. H. James *The Theory of the Photographic Process,* third Edition (1967), New York, The Macmillan Company, chapter 2, pages 36 to 43 (The Size of the Silver Halide Grains), and page 39, respectively.

The monodisperse silver halide emulsion used in the present invention is formed of silver bromide and/or silver chlorobromide each containing substantially no silver iodide, and preferably silver chlorobromide containing from 2 mol % to 80 mol %, more preferably from 2 mol % to less than 50 mol %.

Silver halide grains which can be used in the present invention may have a regular crystal structure, for example, a cubic, octahedral, dodecahedral, or tetradecahedral structure; an irregular crystal structure, for example, a spherical structure; or a composite structure thereof. Further, tabular silver halide grains can be used. Particularly, a silver halide emulsion can be employed wherein tabular silver halide grains having a ratio of diameter/thickness of at least 5 and preferably at least 8 account for at least 50% of the total projected area of the silver halide grains present. In addition, mixtures of silver halide grains having different crystal structures may be used. The crystal structure is not particularly restricted, but cubic grains or tetradecahedral grains are preferred. These silver halide emulsions may be those of the surface latent image type in which latent images are formed mainly on the surface thereof and those of the internal latent image type in which latent images are formed mainly in the interior thereof.

Photographic emulsions as used in the present invention can be prepared in any suitable manner, for example, by the methods as described in P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964). That is, any of an acid process, a neutral process, and an ammonia process can be employed.

Soluble silver salts and soluble halogen salts can be reacted by techniques such as a single jet process, a double jet process, and a combination thereof. In addition, there can be employed a method (a so-called reversal mixing process) in which silver halide grains are formed in the presence of an excess of silver ions. As one system of the double jet process, a so-called controlled double jet process in which the pAg in a liquid phase where a silver halide is formed is maintained at a predetermined level can be preferably employed. This process gives a silver halide emulsion in which the crystal form is regular and the particle size is nearly uniform.

Further, a silver halide emulsion may be employed which is prepared by a so-called conversion method involving a process in which a silver halide previously formed is converted to a silver halide having a lower solubility product before the completion of formation of silver halide grains or in which a silver halide emulsion is subjected to similar halogen conversion after the completion of formation of silver halide grains.

During the step of formation or physical ripening of silver halide grains, cadmium salts, zinc salts, lead salts, thallium salts, iridium salts or complex salts thereof, rhodium salts or complex salts thereof, and iron salts or complex salts thereof may be allowed to coexist.

After the formation of silver halide grains, the silver halide emulsions are usually subjected to physical ripening, removal of soluble salts, and chemical ripening and then employed for coating.

Known silver halide solvents (for example, ammonia, potassium thiocyanate, and thioethers or thione compounds as described in U.S. Pat. No. 3,271,157 and Japanese Patent Application (OPI) Nos. 12360/76, 82408/78, 144319/78, 100717/79, and 155828/79) can be employed during the step of formation, physical ripening, or chemical ripening of the silver halide. It is preferred to employ these compounds during the step of formation of the silver halide grains.

For removal of soluble silver salts from the emulsion after physical ripening, a noodle washing process, a flocculation process, or an ultrafiltration process can be employed.

To the silver halide emulsion which can be used in the present invention, a sulfur sensitization method using active gelatin or compounds containing sulfur capable of reacting with silver or active gelatin (for example, thiosulfates, thioureas, mercapto compounds, and rhodanines), a reduction sensitization method using reducing substances (for example, stannous salts, amines, hydrazine derivatives, formamidinesulfinic acid, and silane compounds), a noble metal sensitization method using metal compounds (for example, complex salts of Group VIII metals in the Periodic Table, such as Pt, Ir, Pd, Rh, or Fe as well as gold complex salts); and so forth can be applied alone or in combination with each other.

Of the above-described chemical sensitizations, a sulfur sensitization alone is preferred.

Further, in order to achieve the desired gradation of the color photographic light-sensitive material, two or more monodisperse silver halide emulsions which have substantially the same spectral sensitivity but have different grain sizes from each other can be mixed in one emulsion layer or can be coated in the form of superimposed layers (regarding monodispersibility, the coefficient of variation described above is preferred).

The yellow couplers represented by formula (I) which can be used in the present invention are described in further detail below.

In formula (I), $R_1$ represents a halogen atom or an alkoxy group; $R_2$ represents a hydrogen atom, a halogen atom or an alkoxy group. The alkyl group represented by $R_3$ or $R_4$ may be any of a straight chain and branched chain alkyl group and has preferably from 1 to 32 carbon atoms.

The alkoxy group represented by $R_2$ or the alkyl group represented by $R_3$ or $R_4$ may be substituted with one or more groups selected from an alkyl group, an aryl group, a heterocyclic group, an alkoxy group (for example, a methoxy group, an ethoxy group, a 2-methoxyethoxy group, etc.), an aryloxy group (for example, a 2,4-di-tert-amylphenoxy group, a 2-chlorophenoxy group, etc.), an alkenyloxy group (for example, a 2-propenyloxy group, etc.), an acyl group (for example, an acetyl group, a benzoyl group, etc.), an ester group (for example, a butoxycarbonyl group, a phenoxycarbonyl group, an acetoxy group, a benzoyloxy group, a butoxysulfonyl group, a toluenesulfonyloxy group, etc.), an amido group (for example, an acetylamino group, a methanesulfonamido group, a dipropylsulfamoylamino group, etc.), a carbamoyl group (for example, a dimethylcarbamoyl group, an ethylcarbamoyl group, etc.), a sulfamoyl group (for example, a butylsulfamoyl group, etc.), an imido group (e.g., a succinimido group, a hydantoinyl group, etc.), a ureido group (for example, a phenylureido group, a dimethylureido group, etc.), an aliphatic or aromatic sulfonyl group (for example, a methanesulfonyl group, a phenylsulfonyl group, etc.), an aliphatic or aromatic thio group (for example, an ethylthio group, a phenylthio group, etc.), a hydroxyl group, a cyano group, a carboxy group, a nitro group, a sulfo group, and a halogen atom, etc.

The group which is capable of being released upon a coupling reaction with an oxidation product of a developing agent and is connected to the coupling position through an oxygen atom or a nitrogen atom, represented by Y preferably includes a group represented by formula (III), (IV), (V) or (VI)

$$-OR_{10} \quad \text{(III)}$$

wherein $R_{10}$ represents an unsubstituted or substituted aryl group or heterocyclic group, (IV)

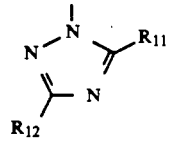

(V)

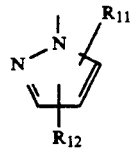

wherein $R_{11}$ and $R_{12}$ (which may be the same or different) each represents a hydrogen atom, a halogen atom, a carboxylic acid ester group, an amino gorup, an alkyl group, and aliphatic gorup, an alkoxy group, an alkylsulfonyl group, an alkylsulfinyl group, a carboxylic acid group, a sulfonic acid group, an unsubstituted or substituted phenyl group or an unsubstituted or substituted heterocyclic group, (VI)

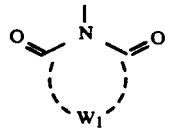

wherein $W_1$ represents non-metallic atoms necessary for forming a 4-membered, 5-membered or 6-membered ring together with the

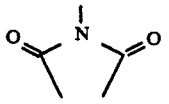

moiety of formula (VI).

Of the groups represented by formula (VI), those represented by formula (VII), (VIII), or (IX) are preferable:

(VII)

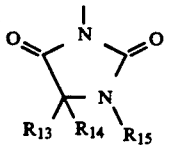

-continued (VIII)

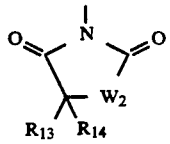

(IX)

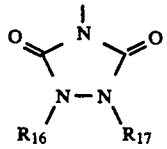

wherein $R_{13}$ and $R_{14}$ each represents a hydrogen atom, an alkyl group, an aryl group, an alkoxy group, an aryloxy group or a hydroxyl group; $R_{15}$, $R_{16}$ and $R_{17}$ each represents a hydrogen atom, an alkyl group, an aryl group, an aralkyl group or an acyl group; and W2 represents an oxygen atom or a sulfur atom.

Specific examples of the yellow couplers represented by the general formula (I) are set forth below, but the present invention should not be construed as being limited thereto.

(I-1)

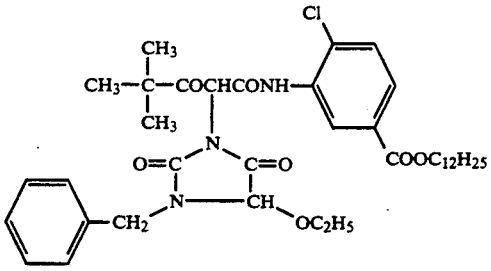

(I-2)

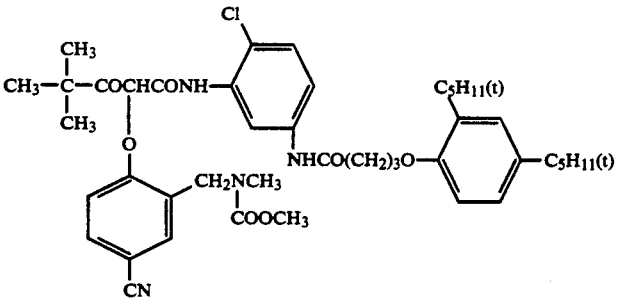

(I-3)

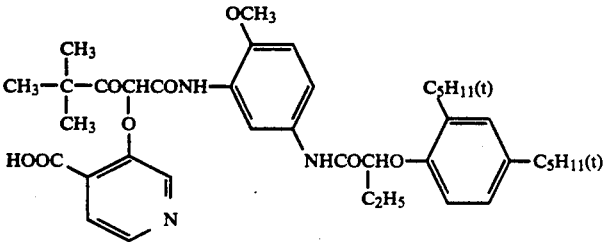

-continued
(I-4)
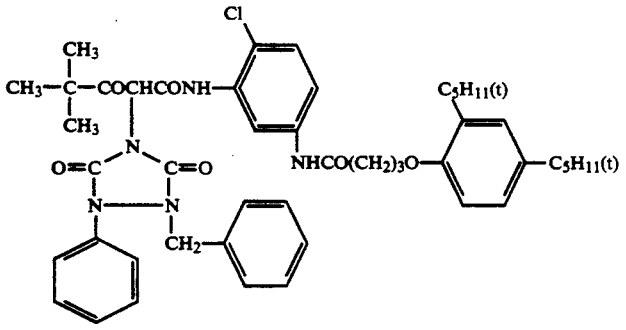
(I-5)
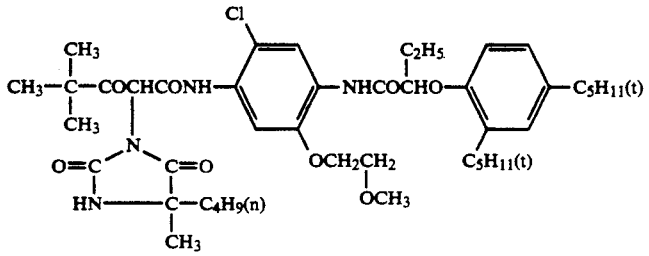
(I-6)
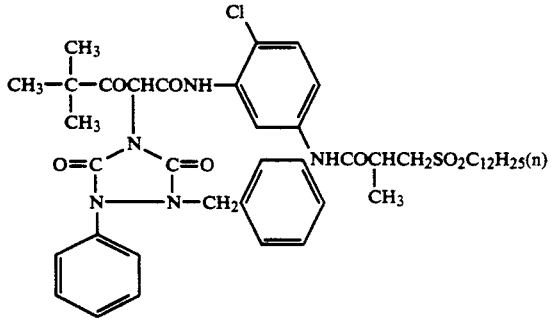
(I-7)
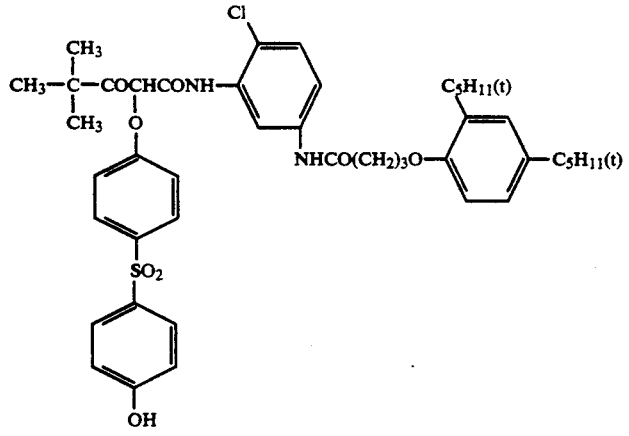

-continued
(I-8)
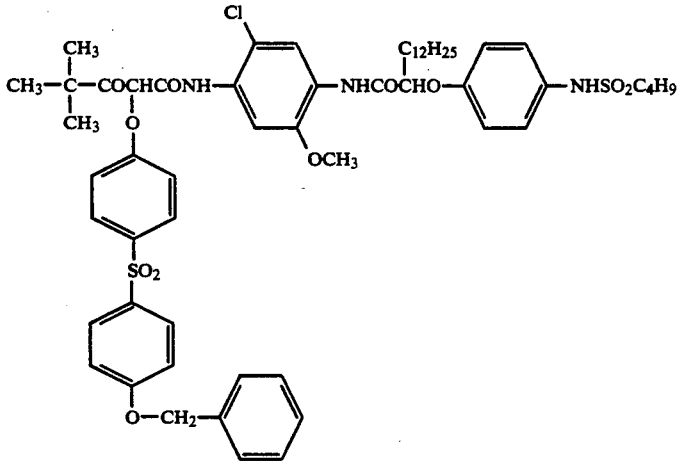
(I-9)
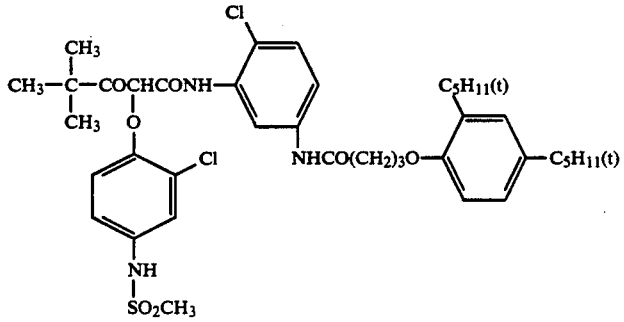
(I-10)
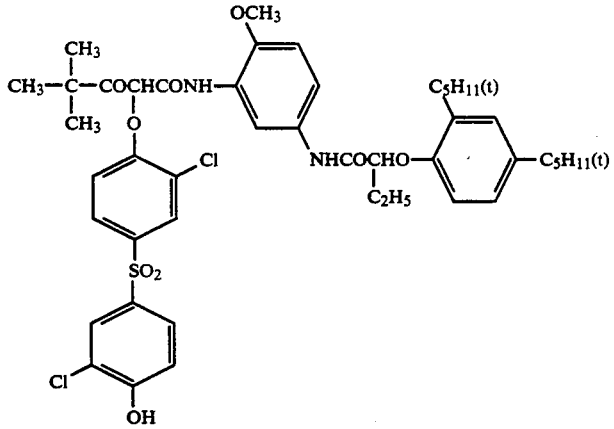
(I-11)
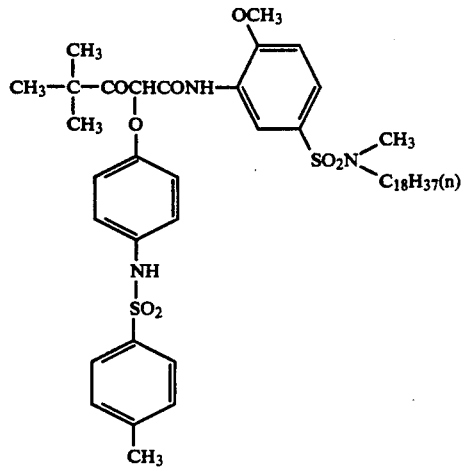

-continued
(I-12)
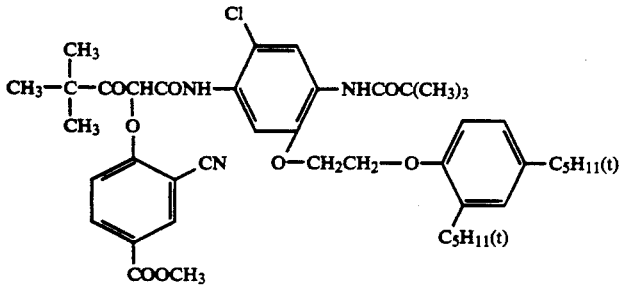
(I-13)
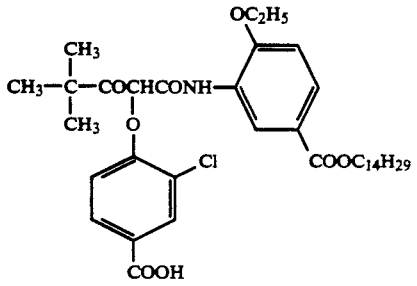
(I-14)
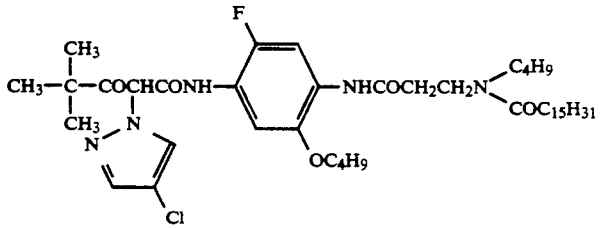
(I-15)
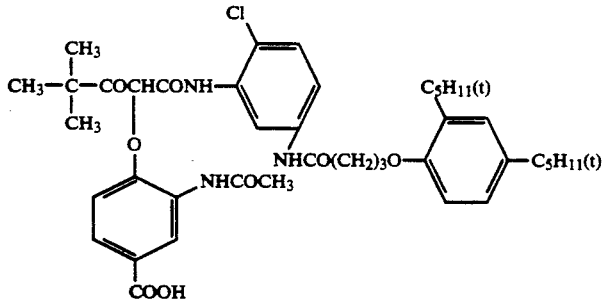
(I-16)
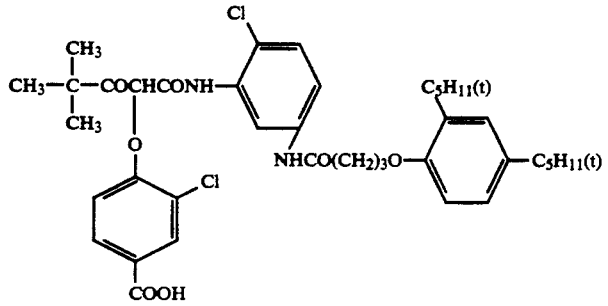

-continued
(I-17)
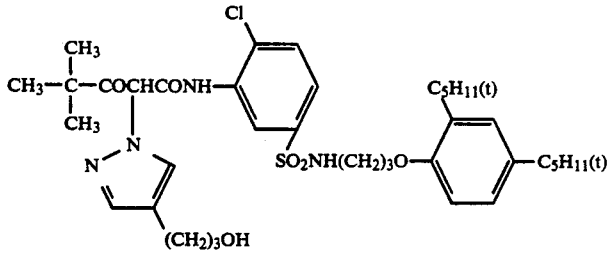
(I-18)
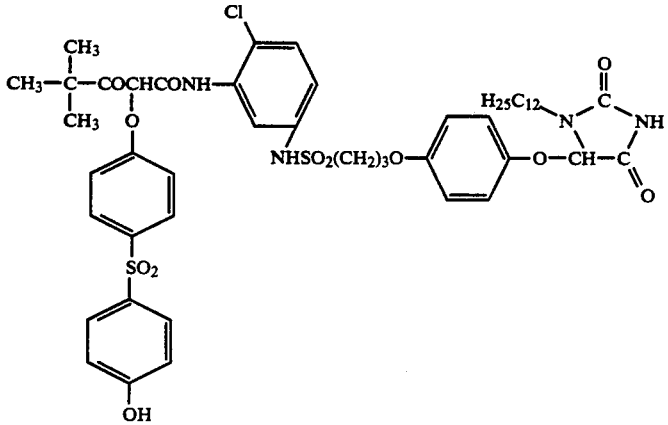
(I-19)
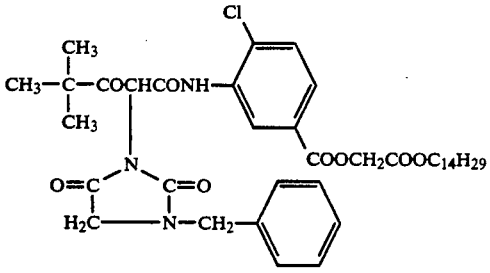
(I-20)
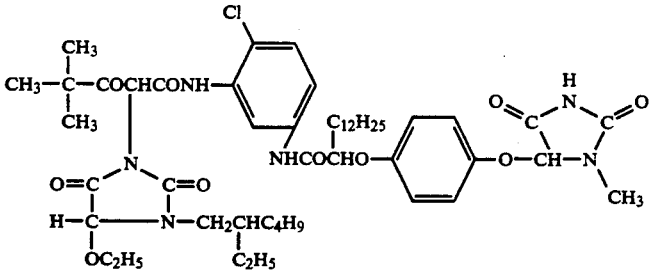
(I-21)
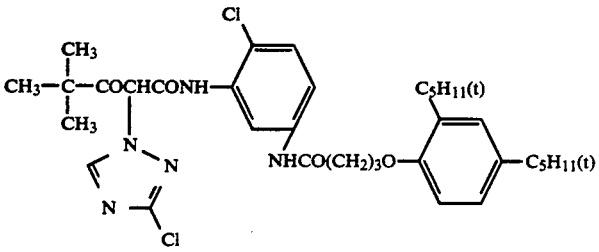

-continued
(I-22)
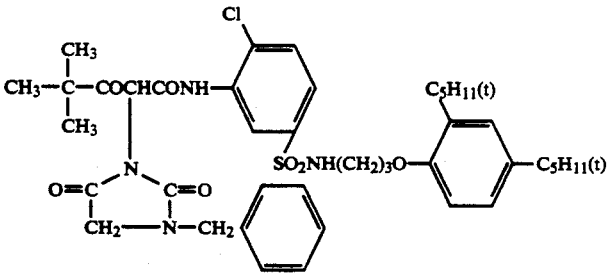
(I-23)
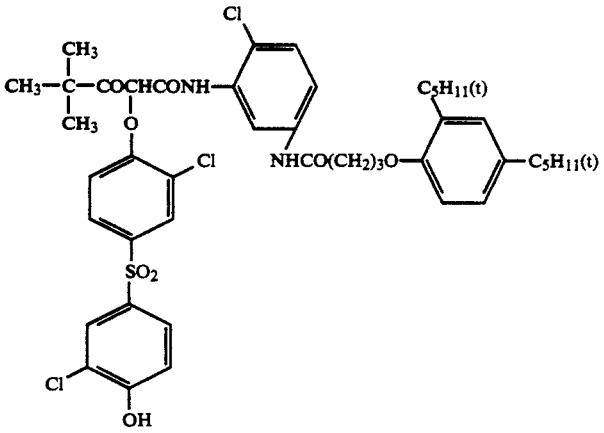
(I-24)
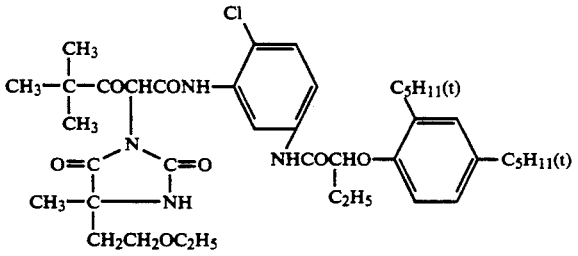
(I-25)
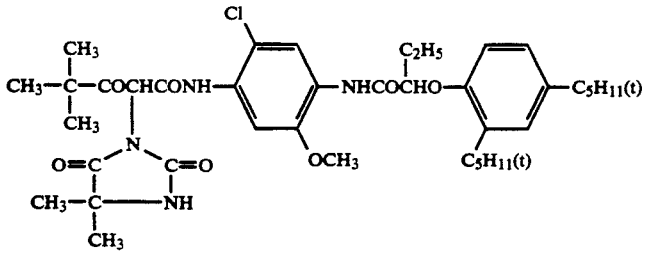
(I-26)
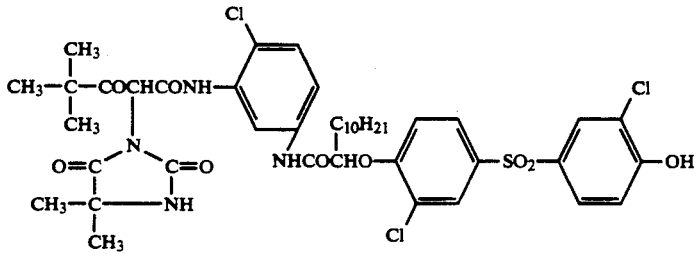

-continued
(I-27)
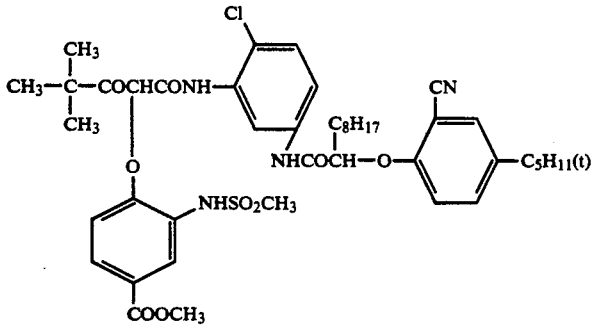
(I-28)
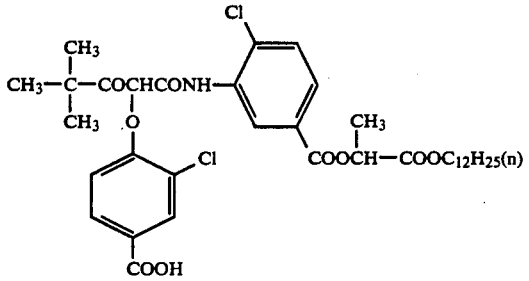
(I-29)
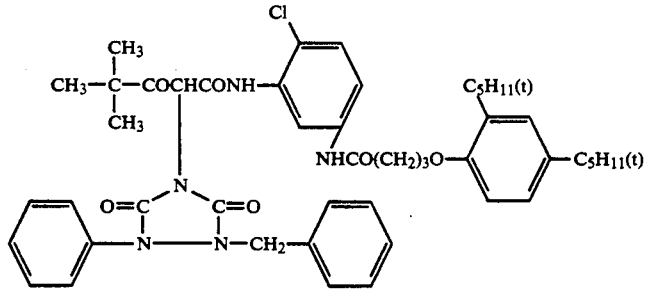
(I-30)
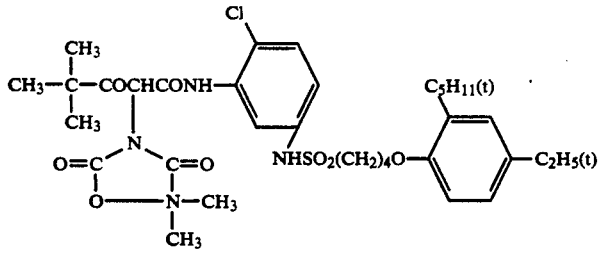
(I-31)
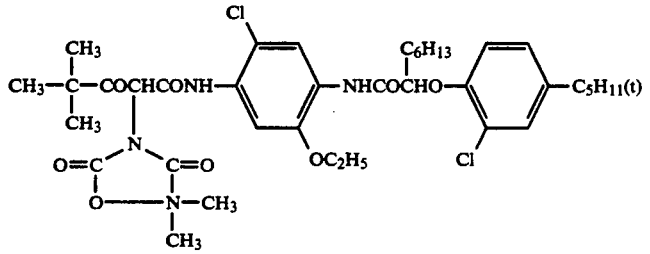

-continued
(I-32)
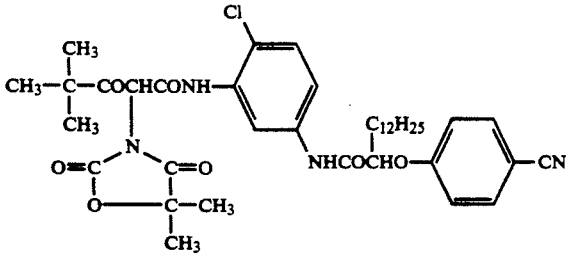
(I-33)
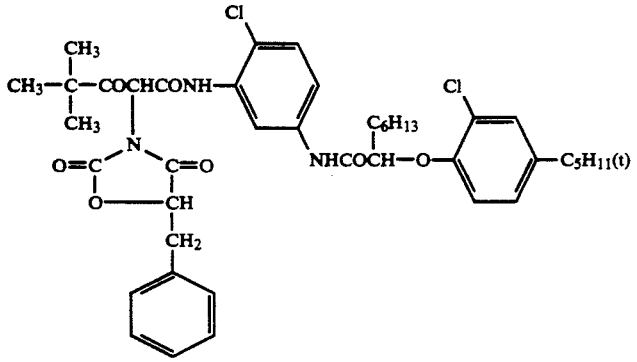
(I-34)
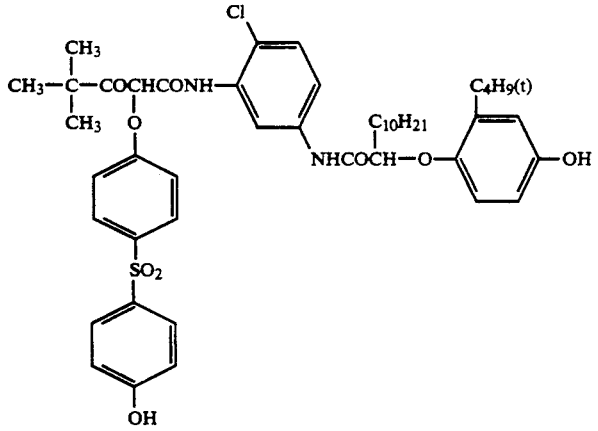
(I-35)
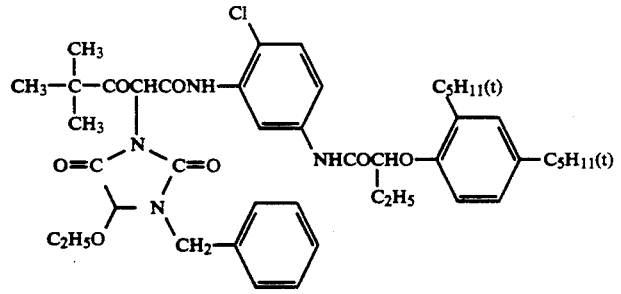
(I-36)
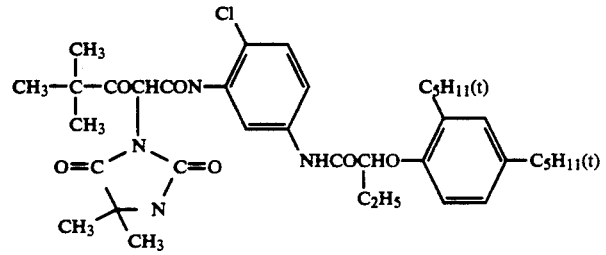

-continued (I-37)

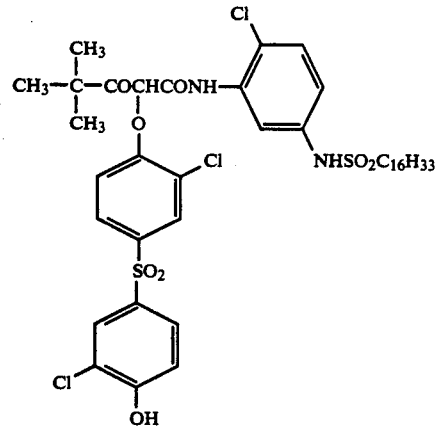

(I-38)

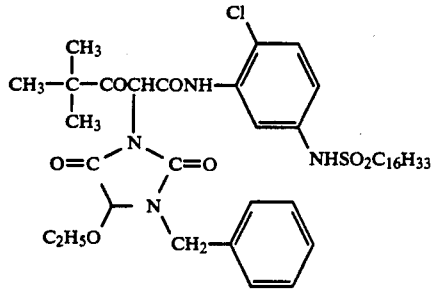

(I-39)

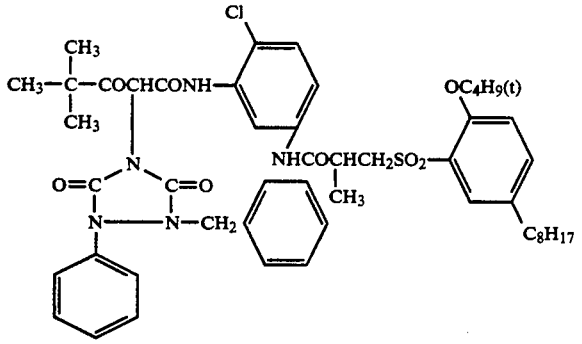

The hydrophobic compounds represented by formula (II) used in the present invention are described in detail below.

In formula (II), $R_5$, $R_6$, $R_7$, $R_8$ and $R_9$, which may be the same or different, each represents a hydrogen atom, a halogen atom (for example, a chlorine atom, a bromine atom, an iodine atom, a fluorine atom), a nitro group, a hydroxy group, an alkyl group (for example, a methyl group, an ethyl group, an n-propyl group, an isopropyl group, an aminopropyl group, an n-butyl group, a sec-butyl group, a tert-butyl group, a chlorobutyl group, an n-amyl group, an isoamyl group, a hexyl group, an octyl group, a nonyl group, a methoxycarbonylethyl group, a dodecyl group, a pentadecyl group, a cyclohexyl group, a benzyl group, a phenethyl group, a phenylpropyl group, etc.), an alkenyl group (for example, a vinyl group, an allyl group, a methallyl group, a dodecenyl group, an octadecenyl group, etc.), an aryl group (for example, a phenyl group, a 4-methylphenyl group, a 4-ethoxyphenyl group, a 3-hexyloxyphenyl group, etc.), an alkoxy group (for example, a methoxy group, an ethoxy group, a propoxy group, a butoxy group, a chlorobutoxy group, a methoxyethoxy group, a pentadecyloxy group, etc.), an aryloxy group (for example, a phenoxy group, a 2-methylphenoxy group, a 4-chlorophenoxy group, etc.), an acyloxy group (for example, a carbomethoxy group, a carbobutoxy group, a carbopentadecyloxy group, etc.), an alkylthio group (for example, a methylthio group, an ethylthio group, a tert-butylthio group, an octylthio group, a benzylthio group, etc.), an arylthio group (for example, a phenylthio group, a methylphenylthio group, an ethylphenylthio group, a methoxyphenylthio group, a naphthylthio group, etc.), a mono- or di-alkylamino group (for example, an N-ethylamino group, an N-tert-octylamino group, an N,N-diethylamino group, etc.), an acylamino group (for example, an acetylamino group, a benzoylamino group, a methanesulfonylamino group, etc.) or a 5-membered or 6-membered heterocyclic group containing an oxygen atom or a nitrogen atom (for example, a piperidino group, a morpholino group, a pyrrolidino group, a piperazino group, etc.); or $R_8$ and $R_9$ may be connected with each other to form a 5-membered or 6-membered aromatic carbon ring.

In formula (II), the total carbon atoms included in the substituents represented by $R_5$ to $R_9$ is preferably from 5 to 36 and the alkyl group preferably contains from 1 to 18 carbon atoms.

Of the compounds represented by formula (II), those represented by formula (X) are particularly preferred:

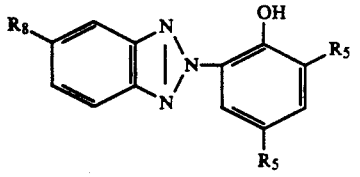

(X)

wherein $R_5$ and $R_6$ each has the same meaning as defined for formula (II); and $R_8$ represents a hydrogen atom, a halogen atom, an alkyl group, an alkoxy group, an aryl group or an aryloxy group, each haing the same meaning as defined for formula (II).

Further, the compounds represented by formula (X), wherein $R_8$ represents a halogen atom are particularly preferred.

Specific examples of the compounds represented by formula (II) are set forth below, but the present invention should not be construed as being limited thereto.

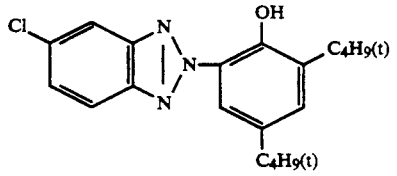

(II-1)

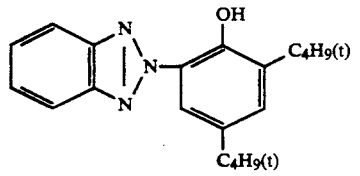

(II-2)

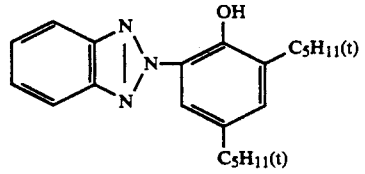

(II-3)

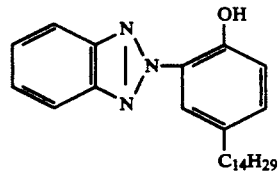

(II-4)

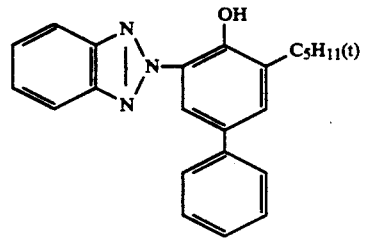

(II-5)

-continued

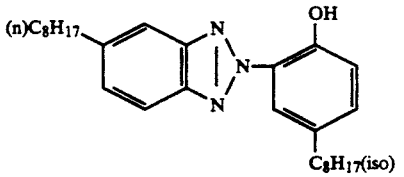

(II-6)

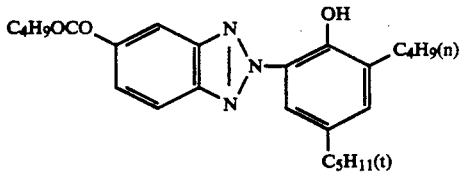

(II-7)

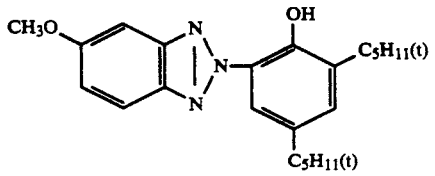

(II-8)

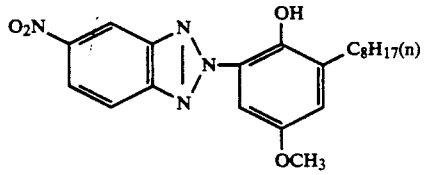

(II-9)

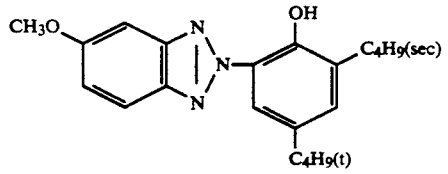

(II-10)

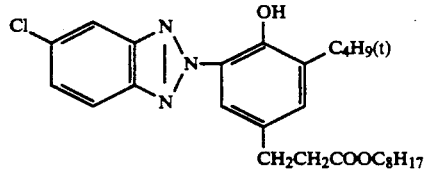

(II-11)

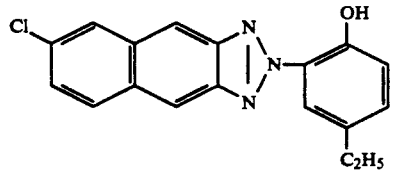

(II-12)

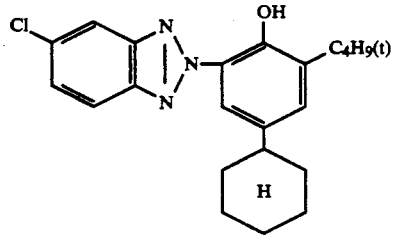

(II-13)

-continued
(II-14)
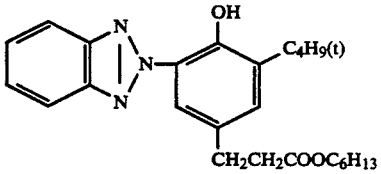
(II-15)
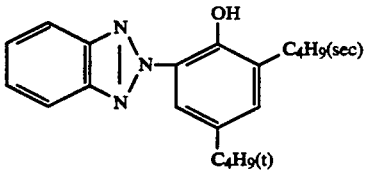
(II-16)
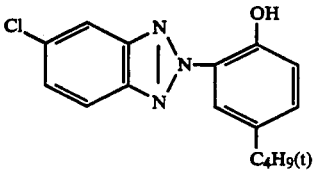
(II-17)
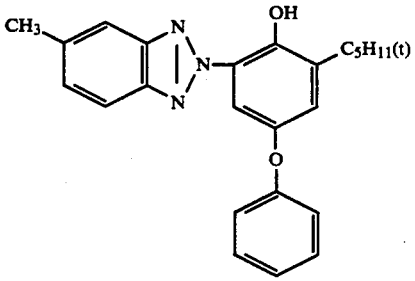
(II-18)
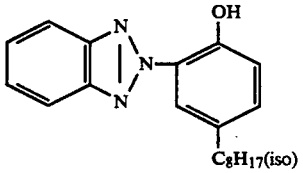
(II-19)
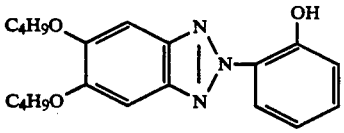
(II-20)
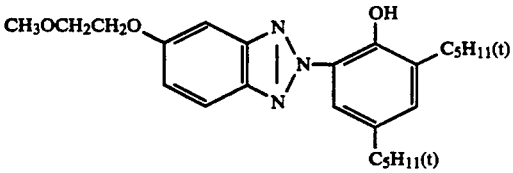
(II-21)
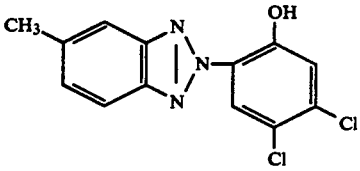
-continued
(II-22)
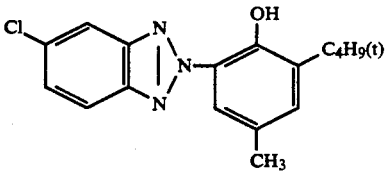
(II-23)
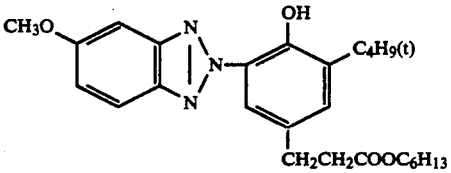
(II-24)
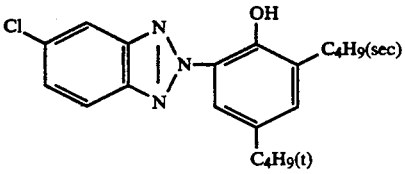
(II-25)
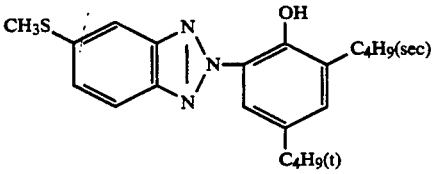
(II-26)
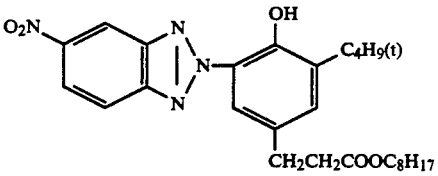
(II-27)
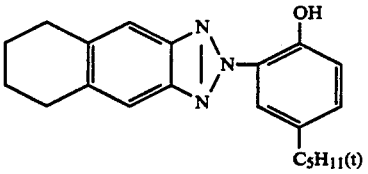
(II-28)
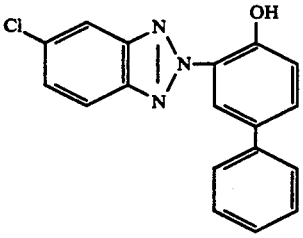
(II-29)
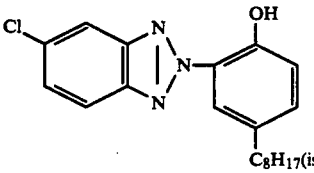

-continued (II-30)

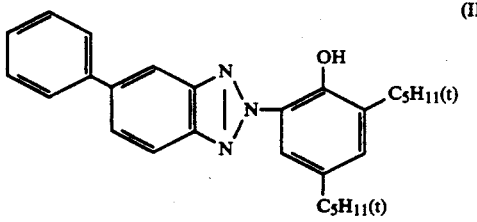

Isomer mixture represented by

II-31

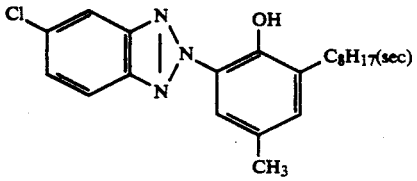

Isomer mixture represented by

II-32

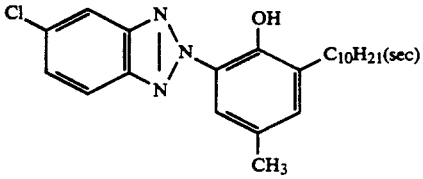

Isomer mixture represented by

II-33

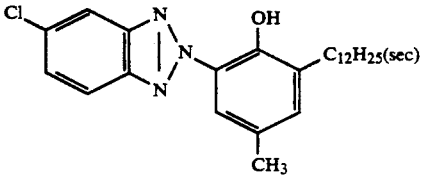

Isomer mixture represented by

II-34

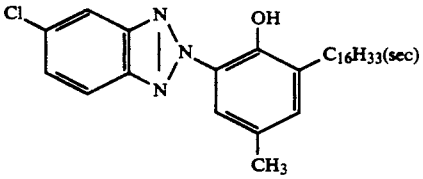

Isomer mixture represented by

II-35

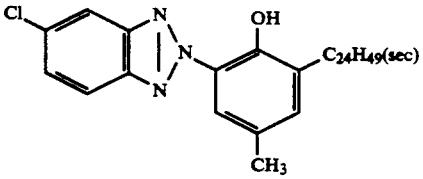

Isomer mixture represented by

II-36

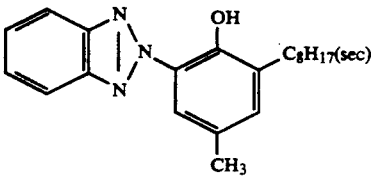

Isomer mixture represented by

-continued

II-37

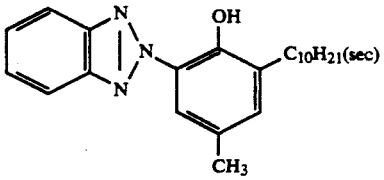

Isomer mixture represented by

II-38

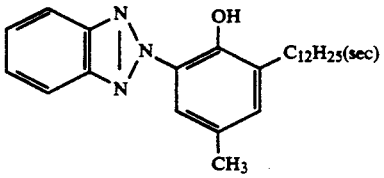

Isomer mixture represented by

II-39

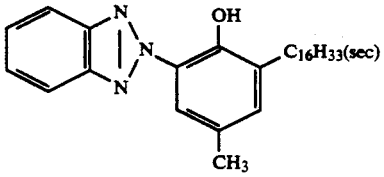

Isomer mixture represented by

II-40

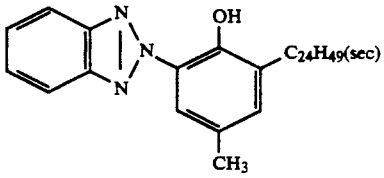

A non-volatile organic solvent which can be used for dispersing the hydrophobic compound represented by formula (II) in the present invention may be any organic solvent having a high boiling point of 175° C. or more as far as it is so selected that a relative refractive index of an organic phase containing the hydrophobic compound represented by (II) with the exception of a volatile organic solvent and an amphipathic solute to a hydrophilic polymer thin film which forms the light-insensitive layer is in a range from 0.9875 to 1.0125. Of these non-volatile organic solvents, those having a refractive index of less than 1.46 are preferred. Further, an alkyl ester of phosphoric acid, an ester of citric acid, an ester of fatty acid, an ester of carbonic acid, an amide, and an ester or ether of fluorine-containing alcohol are more preferable.

Specific examples of the non-volatile organic solvents used in the present invention are set forth below, but the present invention should not be construed as being limited thereto.

| | | Refractive Index |
|---|---|---|
| (O-1) | $O{=}P{+}OC_4H_9)_3$ | 1.424 |
| (O-2) | $O{=}P{+}OCH_2CH(C_2H_5)C_4H_9)_3$ | 1.443 |
| (O-3) | $O{=}P(OC_4H_9){+}OCH_2CH(C_2H_5)C_4H_9)_3$ | 1.440 |
| (O-4) | $O{=}P{+}OC_9H_{19})_3$ | 1.447 |

-continued

| | | Refractive Index |
|---|---|---|
| (O-5) | $O{=}P(OC_{10}H_{21})_3$ | 1.451 |
| (O-6) | $O{=}P(OC_{10}H_{21}\text{-iso})_3$ | 1.453 |
| (O-7) | $O{=}P(OC_{10}H_{21}\text{-iso})(OC_{12}H_{25})$ | 1.453 |
| (O-8) | $O{=}P(OC_{14}H_{29})_3$ | 1.455 |
| (O-9) | $O{=}P(OCH_2CH_2OC_4H_9)_3$ | 1.434 |
| (O-10) | $CH_3COOC(CH_2COOC_2H_5)_3$ | 1.438 |
| (O-11) | $CH_3COOC(CH_2COOC_4H_9)_3$ | 1.441 |
| (O-12) | $CH_3COOC(CH_2COOCH_2CH(C_2H_5)C_4H_9)_3$ | 1.441 |
| (O-13) | $CH_3COOC(CH_2COOC_{12}H_{25})_3$ | 1.453 |
| (O-14) | $HOC(CH_2COOC_6H_{13})_3$ | 1.450 |
| (O-15) | $HOC(CH_2COOC_7H_{15})_3$ | 1.454 |
| (O-16) | $HOC(CH_2COOCH_2CH(C_2H_5)C_4H_9)(CH_2COOCH_2CH(C_2H_5)C_4H_9)(CH_2COOCH_2CH(C_2H_5)C_4H_9)$ | 1.456 |
| (O-17) | $HOC(CH_2COOC_{10}H_{21})_3$ | 1.459 |
| (O-18) | $HOC(CH_2COOC_9H_{19}\text{-iso})_3$ | 1.457 |
| (O-19) | $HOCH(CH_2COOC_{18}H_{37}(\text{iso}))_2$ | 1.459 |
| (O-20) | $C_{17}H_{33}COOCH_3$ | 1.451 |
| (O-21) | $(CH_2COOC_4H_9)_2$ | 1.428 |

-continued

| | | Refractive Index |
|---|---|---|
| (O-22) | $(COOCH_2CH(C_2H_5)C_4H_9)_2(CH_2)_4$ | 1.447 |
| (O-23) | $(COOCH_2(C_2H_5)C_4H_9)_2(CH_2)_7$ | 1.442 |
| (O-24) | $(COOC_4H_9)_2(CH_2)_8$ | 1.439 |
| (O-25) | $(COOCH_2CH(C_2H_5)C_4H_9)_2(CH_2)_8$ | 1.451 |
| (O-26) | $(OCOCH_3)_2(CH_2)_{10}$ | 1.443 |
| (O-27) | $(CH_2OCOC_{17}H_{35})(CHOCOCH_3)(CH_2OCOCH_3)$ | 1.445 |
| (O-28) | $(CH_2COOC_4H_9)(CHCOOC_4H_9)(CH_2COOC_4H_9)$ | 1.433 |
| (O-29) | $(COOC_4H_9)_2(CHOCOCH_3)_2$ | 1.436 |
| (O-30) | $C_{13}H_{27}COOC_{18}H_{37}\text{-iso}$ | 1.454 |
| (O-31) | $C_{13}H_{27}COOCH_2CH(C_6H_{13})C_8H_{17}$ | 1.453 |
| (O-32) | $C_8H_{17}OCOOC_8H_{17}$ | 1.439 |
| (O-33) | $C_{12}H_{25}OC(=O)OC_{12}H_{25}$ | 1.449 |
| (O-34) | $C_7H_{15}CON(CH_3)_2$ | 1.453 |
| (O-35) | $C_7H_{15}CON(C_2H_5)_2$ | 1.450 |
| (O-36) | $C_{11}H_{23}CON(CH_3)_2$ | 1.453 |
| (O-37) | $C_{11}H_{23}CON(C_2H_5)_2$ | 1.455 |
| (O-38) | 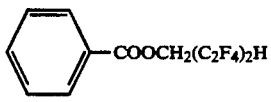 | 1.422 |
| (O-39) | 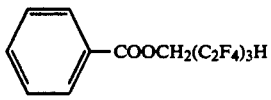 | 1.403 |

-continued

| | | Refractive Index |
|---|---|---|
| (O-40) | 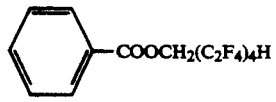 | 1.402 |
| (O-41) | 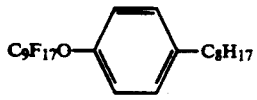 | 1.414 |
| (O-42) | 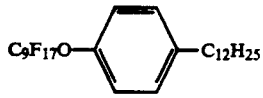 | 1.425 |
| (O-43) | 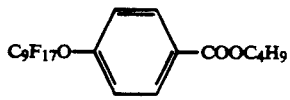 | 1.413 |

The amount of the yellow coupler represented by formula (I) used in the present invention is not particularly restricted, but it is preferably from 0.3 g/m$^2$ to 1.5 g/m$^2$ and from 0.01 mol to 0.5 mols per mol of blue-sensitive silver halide, and more preferably from 0.5 g/m$^2$ to 1.1 g/m$^2$ and from 0.025 mols to 0.45 mols per mol of blue-sensitive silver halide, respectively.

The amount of the hydrophobic compound represented by the general formula (II) used is usually from 0.3 g/m$^2$ to 1.2 g/m$^2$, preferably from 0.45 g/m$^2$ to 1.0 g/m$^2$, since the amount thereof is too large, yellow coloration may occur in unexposed areas (white background areas) of color photographic materials containing it. Further, the amount of the non-volatile organic solvent having a refractive index of less than 1.46 which is used for dispersing the hydrophobic compound represented by the general formula (II) according to the present invention is also not particularly restricted, but it is usually from 0.1 ml/m$^2$ to 0.8 ml/m$^2$, preferably from 0.2 ml/m$^2$ to 0.5 ml/m$^2$.

Each of blue-sensitive, green-sensitive, and red-sensitive emulsions used in the present invention can be spectrally sensitized with methine dyes or other dyes so as to have each color sensitivity. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes, and complex merocyanine dyes are particularly useful.

Any conventionally utilized nuclei for cyanine dyes are applicable to these dyes as basic heterocyclic nuclei. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus, and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms on these nuclei can also be substituted.

The merocyanine dyes and the complex merocyanine dyes that can be employed contain 5- or 6-membered heterocyclic nuclei such as a pyrazolin-5-one nucleus, a thiohydantoin nucleus, a 2-thioxazolidin-2,4-dione nucleus, a thiazolidon-2,4-dione nucleus, a rhodanine nucleus, and a thiobarbituric acid nucleus as nuclei having a ketomethylene structure.

These sensitizing dyes can be employed individually, but can also be employed in combination. A combination of sensitizing dyes is often used particularly for the purpose of supersensitization. Typical examples of supersensitizing combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents 1,344,281 and 1,507,803, Japanese Patent Publication Nos. 4936/68 and 12375/78, and Japanese Patent Application (OPI) Nos. 110618/77 and 109925/77.

The sensitizing dyes may be present in the emulsion together with dyes which themselves do not give rise to spectrally sensitizing effects but exhibit a supersensitizing effect or materials which do not substantially absorb visible light but exhibit a supersensitizing effect.

It is preferable that color couplers which are incorporated into photographic light-sensitive materials are diffusion resistant by means of containing a ballast group or polymerizing. It is also preferred that the coupling active sites of couplers be substituted with a group capable of being released (2-equivalent couplers) rather than with a hydrogen atom (4-equivalent couplers) from the standpoint that the coating amount of silver is reduced. Further, couplers which form dyes having an appropriate diffusibility, non-color-forming couplers, or couplers capable of releasing development inhibitors (DIR couplers) accompanying the coupling reaction or couplers capable of releasing development accelerators accompanying the coupling reaction can be employed.

As magenta couplers used in the present invention, oil protected indazolone type couplers and cyanoacetyl type couplers, preferably 5-pyrazolone type couplers and pyrazoloazole type couplers such as pyrazolotriazoles, are exemplified. Of 5-pyrazolone type couplers, those substituted with an arylamino group or an acylamino group at the 3-position thereof are preferred in view of hue and color density of the dyes formed. Typical examples thereof are described in U.S. Pat. Nos. 2,311,082, 2,343,703, 2,600,788, 2,908,573, 3,062,653, 3,152,896, and 3,936,015. Two-equivalent 5-pyrazolone type couplers containing nitrogen atom-releasing groups as described in U.S. Pat. No. 4,310,619 and arylthio groups as described in U.S. Pat. No. 4,351,897, as releasing groups are preferred. Further, 5-pyrazolone type couplers having a ballast group as described in European Patent 73,636 are advantageous because they provide high color density.

Examples of pyrazoloazole type couplers include pyrazolobenzimidazoles as described in U.S. Pat. No. 3,369,879, and preferably pyrazolo[5,1-c][1,2,4]triazoles as described in U.S. Pat. No. 3,725,067, pyrazolotetrazoles as described in Research Disclosure, RD No. 24220 (June, 1084), and pyrazolopyrazoles as described in *Research Disclosure*, RD No. 24230 (June, 1984). Imidazo[1,2-b]-pyrazoles as described in European Patent 119,741 are preferred, and pyrazolo[1,5-b][1,2,4]triazoles as described in European Patent 119,860 are particularly preferred in view of less yellow subsidiary absorption and light fastness of the dyes formed.

As cyan couplers used in the present invention, oil protected naphthol type and phenol type couplers are exemplified. Typical examples thereof include naphthol type couplers as described in U.S. Pat. No. 2,474,293 and preferably oxygen atom-releasing type 2-equivalent naphthol type couplers as described in U.S. Pat. Nos. 4,052,212, 4,146,396, 4,228,233, and 4,296,200. Specific examples of phenol type couplers are described in U.S. Pat. Nos. 2,369,929, 2,801,171, 2,772,162, and 2,895,826.

Cyan couplers fast to humidity and temperature are preferably used in the present invention. Typical examples thereof include phenol type cyan couplers having an alkyl group larger than a methyl group at the meta-position of the phenol nucleus as described in U.S. Pat. No. 3,772,002; 2,5-diacylamino-substituted phenol type couplers as described in U.S. Pat. Nos. 2,772,162, 3,758,308, 4,126,396, 4,334,011, and 4,327,173, West German Patent Application (OLS) No. 3,329,729, and Japanese Patent Application No. 42671/83; and phenol type couplers having a phenylureido group at the 2-position thereof and an acylamino group at the 5-position thereof as described in U.S. Pat. Nos. 3,446,622, 4,333,999, 4,451,559, and 4,427,767.

Further, couplers capable of forming appropriately diffusible dyes can be used together in order to improve graininess. Specific examples of such dye diffusible types of magenta couplers are described in U.S. Pat. No. 4,366,237 and British Patent 2,125,570, and those of yellow, magenta, and cyan couplers are described in European Patent 96,570 and West German Patent Application (OLS) No. 3,234,533.

These dye-forming couplers and special couplers described above may be used in the form of polymers including dimers or more. Typical examples of dye-forming polymer couplers are described in U.S. Pat. Nos. 3,451,820 and 4,080,211. Specific examples of magenta polymer couplers are described in British Patent 2,102,173 and U.S. Pat. No. 4,367,282.

Two or more kinds of various couplers which can be used in the present invention can be incorporated together into the same layer for the purpose of satisfying the properties required of the color photographic light-sensitive materials, or the same compound can be incorporated into two or more different layers.

Couplers which can be used in the present invention may be introduced into the color photographic light-sensitive material using an oil-in-water droplet type dispersing method. By means of the oil-in-water droplet type dispersing method, couplers are dissolved in either an organic solvent having a high boiling point of 175° C. or more, a so-called auxiliary solvent having a low boiling point, or a mixture thereof, and then, the solution is finely dispersed in an aqueous medium such as water or an aqueous gelatin solution in the presence of a surface active agent. Specific examples of the organic solvent having a high boiling point are described, for example, in U.S. Pat. No. 2,322,027. Preparation of a dispersion may be accompanied by phase inversion. Further, dispersions can be utilized for coating after removing or reducing the auxiliary solvent therein by distillation, noodle washing, or ultrafiltration, if desired.

Specific examples of the organic solvent having a high boiling point include phthalic acid esters (for example, dibutyl phthalate, dicyclohexyl phthalate, di-2-ethylhexyl phthalate, and didecyl phthalate), phosphoric or phosphonic acid esters (for example, triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, and di-2-ethylhexylphenyl phosphonate), benzoic acid esters (for example, 2-ethylhexyl benzoate, dodecyl benzoate, and 2-ethylhexyl-p-hydroxybenzoate), amides (for example, diethyldodecanamide and N-tetradecylpyrrolidone), alcohols or phenols (for example, isostearyl alcohol and 2,4-di-tert-amylphenol), aliphatic carboxylic acid esters (for example, dioctyl azelate, glycerol tributyrate, isostearyl lactate, and trioctyl citrate), aniline derivatives (for example, N,N-dibutyl-2-butoxy-5-tert-octylaniline), and hydrocarbons (for example, paraffins, dodecylbenzene, and diisopropylnaphthalene). As the auxiliary solvent, organic solvents having a boiling point of about 30° C. or more, preferably from about 50° C. to about 160° C., can be used. Typical examples of such auxiliary solvents include ethyl acetate, butyl acetate, ethyl propionate, methyl ethyl ketone, cyclohexanone, 2-ethoxyethyl acetate, and dimethylformamide.

The processes and effects of latex dispersing methods and the specific examples of latices for impregnation are described in U.S. Pat. No. 4,199,363 and West German Patent Application (OLS) No. 2,541,274 and 2,541,230.

The color couplers are generally employed in an amount of from 0.001 mol to 1 mol per mol of the light-sensitive silver halide contained in a layer to be added. It is preferred that amounts of yellow couplers, magenta couplers, and cyan couplers used are in ranges of from 0.01 mol to 0.5 mol, from 0.003 mol to 0.3 mol, and from 0.002 mol to 0.3 mol, respectively, per mol of the light-sensitive silver halide.

The color photographic light-sensitive material used in the present invention may contain hydroquinone derivatives, aminophenol derivatives, amines, gallic acid derivatives, catechol derivatives, ascorbic acid derivatives, non-color-forming couplers, and sulfonamidophenol derivatives, as color fog preventing agents or color mixing preventing agents.

In the color photographic light-sensitive material used in the present invention, various known color fading preventing agents can be employed. Typical examples of organic color fading preventing agents include hindered phenols, for example, hydroquinones, 6-hydroxychromans, 5-hydroxycoumarans, spirochromans, p-alkoxyphenols, and bisphenols; gallic acid derivatives, methylenedioxybenzenes, aminophenols, hindered amines, or ether or ester derivatives thereof derived from each of these compounds by silylation or alkylation of the phenolic hydroxyl group thereof. Further, metal complexes represented by (bis-salicylaldoxymate) nickel complexes and (bis-N,N-dialkyldithiocarbamate) nickel complexes may be employed.

For the purpose of preventing degradation of yellow dye images due to heat, humidity, and light, compounds each having both a hindered amine partial structure and a hindered phenol partial structure in the molecule as described in U.S. Pat. No. 4,268,593 provide good results. For the purpose of preventing degradation of magenta dye images, particularly degradation due to light, spiroindanes as described in Japanese Patent Application (OPI) No. 159644/81 and chromans substituted with a hydroquinone diether or monoether as described in Japanese Patent Application (OPI) No. 89835/80 provide preferred results.

In order to improve preservability, particularly light fastness of cyan dye images, it is preferred to employ together a benzotriazole type ultraviolet light absorbing agent. Such an ultraviolet light absorbing agent may be emulsified together with a cyan coupler.

A coating amount of the ultraviolet light absorbing agent represented by formula (II) is selected so as to sufficiently improve the light stability of cyan dye images. When the amount of the ultraviolet light absorbing agent employed is too large, yellow coloration may occur in unexposed areas (white background areas) of color photographic materials containing them. Therefore, usually the amount is preferably determined in a range of from $1\times10^{-4}$ mol/m$^2$ to $5\times10^{-3}$ mol/m$^2$ and particularly preferably from $8\times10^{-4}$ mol/m$^2$ to $3.5\times10^{-3}$ mol/m$^2$.

In color paper having a conventional light-sensitive layer structure, the ultraviolet light absorbing agent is incorporated into one of two layers adjacent to a red-sensitive emulsion layer containing a cyan coupler and preferably both thereof. When the ultraviolet light absorbing agent is incorporated into an interlayer positioned between a green-sensitive emulsion layer and a red-sensitive emulsion layer, it may be emulsified together with a color mixing preventing agent. In the case of adding the ultraviolet light absorbing agent to a protective layer, another protective layer may be separately provided thereon as an outermost layer. Into the outermost protective layer, a matting agent having an appropriate particle size can be incorporated.

The color photographic light-sensitive material used in the present invention may contain an ultraviolet light absorbing agent in a hydrophilic colloid layer thereof.

The color photographic light-sensitive material used in the present invention may contain water-soluble dyes as filter dyes or for irradiation or halation prevention or other various purposes in a hydrophilic colloid layer thereof.

The color photographic light-sensitive material used in the present invention may contain in the photographic emulsion layers or other hydrophilic colloid layers a brightening agent of the stilbene series, triazine series, oxazole series, or coumarin series Water-soluble brightening agents can be employed. Also, water-insoluble brightening agents may be used in the form of a dispersion.

The present invention can be applied to a multilayer multicolor photographic light-sensitive material having at least two differently spectrally sensitized silver halide photographic emulsion layers on a support. The multilayer natural color photographic light-sensitive material usually has at least one red-sensitive silver halide emulsion layer, at least one green-sensitive silver halide emulsion layer, and at least one blue-sensitive silver halide emulsion layer on a support. The order of the disposition of these emulsion layers can be suitably selected depending in demands.

Further, each of the above-described emulsion layers may be composed of two or more emulsion layers having different sensitivities. Moreover, between two or more emulsion layers sensitive to the same spectral wavelength range, a light-insensitive layer may be present.

In the color photographic light-sensitive material according to the present invention, it is preferred to provide further layers such as a protective layer, an interlayer, a filter layer, an antihalation layer, and a back layer appropriately, in addition to the silver halide emulsion layers.

As the binder or the protective colloid for the photographic emulsion layers or interlayers of the color photographic light-sensitive material according to the present invention, gelatin is advantageously used, but other hydrophilic colloids can also be used.

For example, it is possible to use proteins such as gelatin derivatives, graft polymers of gelatin and other polymers, albumin, and casein; saccharide derivatives such as cellulose derivatives (e.g., hydroxyethyl cellulose, carboxymethyl cellulose, and cellulose sulfate), sodium alginate, and starch derivatives; and various synthetic hydrophilic high molecular weight substances such as homopolymers or copolymers (e.g., polyvinyl alcohol, polyvinyl alcohol semiacetal, poly-N-vinylpyrrolidone, polyacrylic acid, polymethacrylic acid, polyacrylamide, polyvinylimidazole, and polyvinylpyrazole).

As gelatin, not only lime-processed gelatin but also acid-processed gelatin and enzyme-processed gelatin as described in *Bull. Soc. Sci. Phot. Japan,* No. 16, page 30 (1966) may be used. Further, hydrolyzed products of gelatin or enzymatically decomposed products of gelatin can also be used.

Moreover, into the color photographic light-sensitive material according to the present invention can be incorporated various kinds of stabilizers, contamination preventing agents, developing agents or precursors thereof, development accelerating agents or precursors thereof, lubricants, mordants, matting agent, antistatic agents, plasticizers, or other additives useful for photographic light-sensitive materials in addition to the above-described additives. Typical examples of these additives are described in *Research Disclosure,* RD No. 17643 (December, 1978) and ibid., RD No. 18716 (November, 1979).

The term "reflective support" which can be employed in the present invention means a support having an increased reflection property for the purpose of rendering dye images formed in the silver halide emulsion layer clear. Examples of the reflective support include a support having coated thereon a hydrophobic resin containing a light reflective substance such as titanium oxide, zinc oxide, calcium carbonate, or calcium sulfate dispersed therein and a support composed of a hydrophobic resin containing a light reflective substance dispersed therein. More specifically, they include baryta coated paper, polyethylene coated paper, polypropylene type synthetic paper, transparent supports having a reflective layer or having incorporated therein a reflective substance, for example, a glass plate, a polyester film (such as a polyethylene terephthalate film), a cellulose triacetate film, and a cellulose nitrate film, a polyamide film, a polycarbonate film, and a polystyrene film. A suitable support can be appropriately selected depending on the purpose of use.

The processing steps (image forming steps) which are applied to the present invention are described in more detail below.

A color developing solution which can be used in development processing according to the present invention is an alkaline aqueous solution containing preferably an aromatic primary amine type color developing agent as a main component. As the color developing agent, a p-phenylenediamine type compound is preferably employed. Typical examples of the p-phenylenediamine type compounds include 3-methyl-4-amino-N,N-diethylaniline, 3-methyl-4-amino-N-ethyl-N-8-hydroxyethylaniline, 3-methyl-4-amino-N-ethyl-N-8-methanesulfonamidoethylaniline, 3-methyl-4-amino-N-ethyl-N-8-methoxyethylaniline, or a sulfate, a hydrochloride, a phosphate, a p-toluenesulfonate, a tetraphenylborate or a p-(tert-octyl)benzenesulfonate thereof, etc.

Aminophenol type derivatives which can be used include, for example, o-aminophenol, p-aminophenol, 4-amino-2-methylphenol, 2-amino-3-methylphenol, 2-oxy-3-amino-1,4-dimethylbenzene, etc.

In addition, the compounds as described in L. F. A. Mason, *Photographic Processing Chemistry*, Focal Press, pages 226 to 229 (1966), U.S. Pat. Nos. 2,193,015 and 2,592,364, Japanese Patent Application (OPI) No. 64933/73, etc., may be used.

Two or more kinds of color developing agents may be employed in a combination thereof, if desired.

The processing temperature of color developing solution used in the present invention is preferably from 30° C. to 50° C., and more preferably from 35° C. to 45° C.

The color developing solution used in the present invention may contain, as an appropriate development accelerator, various compounds including benzyl alcohol. Examples of such development accelerators include the various pyrimidium compounds and other cationic compounds as described, for example, in U.S. Pat. No. 2,648,604, Japanese Patent Publication No. 9503/69, and U.S. Pat. No. 3,171,247; cationic dyes such as phenosafranine; neutral salts such as thallium nitrate or potassium nitrate; polyethylene glycol and the derivatives thereof as described in Japanese Patent Publication No. 9304/69, U.S. Pat. Nos. 2,533,990, 2,531,832, 2,950,970 and 2,577,127; nonionic compounds such as polythioethers; and thioether type compounds as described in U.S. Pat. No. 3,201,242; compounds as described in Japanese Patent Application (OPI) Nos. 156934/83 and 220344/85; etc.

As suitable antifoggants used in the color developing solution, alkali metal halides such as potassium bromide, sodium bromide or potassium iodide, and organic antifoggants are preferred. Examples of organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, hydroxyazaindolizine, etc.; mercapto-substituted heterocyclic compounds such as 1-phenyl-5-mercaptotetrazole, 2-mercaptobenzimidazole, 2-mercaptobenzothiazole, etc; and mercapto-substituted aromatic compounds such as thiosalicyclic acid, etc. Of these compounds, halides are particularly preferred. These antifoggants may be dissolved from color photographic light-sensitive materials in a color developing solution during processing and accumulated in the color developing solution.

The color developing solution used in the present invention can further contain pH buffering agents, such as carbonates, borates, or phosphates of alkali metals, etc.; preservatives such as hydroxylamine, triethanolamine, the compounds as described in West German Patent Application (OPI) No. 2,622,950, sulfites, bisulfites, etc.; organic solvents such as diethylene glycol, etc.; dye forming couplers; competing couplers; nucleating agents such as sodium borohydride, etc.; auxiliary developing agents such as 1-phenyl-3-pyrazblidone, etc.; viscosity imparting agents; and chelating agents including aminopolycarboxylic acids as represented by ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid, the compounds as described in Japanese Patent Application (OPI) No. 195845/83, etc., organic phosphonic acids such as 1-hydroxyethylidene-1,1'-diphosphonic acid, those as described in *Research Disclosure*, RD No. 18170 (May, 1979), etc., aminophosphonic acids such as aminotris(methylenephosphonic acid), ethylenediamine-N,N,N',N'-tetramethylene enephosphonic acid, etc., phosphonocarboxylic acids as described in Japanese Patent Application (OPI) Nos. 102726/77, 42730/78, 121127/79, 4024/80, 4025/80, 126241/80, 65955/80 and 65956/80, *Research Disclosure*, No. 18170 (May, 1979), etc.

Furthermore, the color development bath can be divided into two or more baths, if desired, and a replenisher for color developing solution may be supplied from the first bath or the last bath in order to shorten the developing time or reduce the amount of replenisher required.

After color development, the silver halide color photographic material is usually subjected to a bleach processing. The bleach processing may be performed simultaneously with a fix processing (bleach-fixing), or they may be performed independently.

Bleaching agents which can be used include compounds of polyvalent metals, for example, iron (III), cobalt (III), chromium (VI), and copper (II), peracids, quinones and nitroso compounds. For example, ferricyanides; dichromates; organic complex salts of iron (III) or cobalt (III), for example, complex salts of aminopolycarboxylic acids (e.g., ethylenediaminetetraacetic acid, diethylenetriaminepentaacetic acid, nitrilotriacetic acid, 1,3-diamino-2-propanoltetraacetic acid, etc.) or organic acids (e.g., citric acid, tartaric acid, malic acid, etc.); persulfates; permanganates; nitrosophenol, etc. can be used. Of these compounds, potassium ferricyanide, sodium iron (III) ethylenediaminetetraacetate, ammonium iron (III) ethylenediaminetetracetate, ammonium iron (III) triethylenetetraminepentaacetate, and a persulfate are particularly preferred. Further, ethylenediaminetetraacetic acid iron (III) complex salts are useful in both an independent bleaching solution and a mono-bath bleach-fixing solution.

In the bleaching solution or the bleach-fixing solution, various kinds of accelerators may be employed together, if desired. Examples thereof used include bromine ions, iodine ions, thiourea type compounds as described in U.S. Pat. No. 3,706,561, Japanese Patent Publication Nos. 8506/70 and 26586/74, Japanese Patent Application (OPI) Nos. 32735/78, 36233/78 and 37016/78, etc., thiol type compounds as described in Japanese Patent Application (OPI) Nos. 124424/78, 95631/78, 57831/78, 32736/78, 65732/78 and 52534/79, U.S. Pat. No. 3,893,858, etc., heterocyclic compounds as described in Japanese Patent Application (OPI) Nos. 59644/74, 140129/75, 28426/78, 141623/78, 104232/78 and 35727/79, etc., thioether type compounds as described in Japanese Patent Application (OPI) Nos. 20832/77, 25064/80 and 26506/80, etc., quaternary amines as described in Japanese Patent Application (OPI) No. 84440/73, etc., thiocarbamoyls as described in Japanese Patent Application (OPI) No. 42349/74, etc., or the like.

As fixing agents which can be used in a bleach-fixing solution or a fixing solution, thiosulfates, thiocyanates, thioether type compounds, thioureas, a large amount of iodides, etc. are suitable. Thiosulfates can be generally employed. In the bleach-fixing solution or the fixing solution, sulfites, bisulfites or carbonylbisulfite adducts are preferably employed as preservatives.

After the bleach-fixing processing or the fixing processing, water washing processing is usually carried out. In the water washing step, various known compounds may be employed for the purpose of preventing precipitation or saving water, etc. For example, a water softener such as an inorganic phosphoric acid, an aminopolycarboxylic acid or an organic phosphoric acid, etc. for preventing the formation of precipitates; a sterilizer or antimold for preventing the propagation of various bacteria, algae and molds; a hardening agent such as a magnesium salt or an aluminum salt, etc.; or a surface active agent for reducing drying load or preventing drying marks, or the like, may be added, if desired. Further, compounds as described in L. E. West, *Photo. Sci. and Eng.*, Vol. 9, No. 6 (1965) may be added. Particularly, the addition of chelating agents and antimolds is effective.

The water washing step may be carried out using a multi-stage countercurrent water washing processing (for example, with two to five tanks) in order to save water. In this case, the increase in the residence time of the water in tanks causes propagation of bacteria and other problems, for example, adhesion of floatage formed on the photographic materials occur. In order to solve such problems, a method for reducing amounts of calcium and magnesium as described in Japanese Patent Application (OPI) No. 288838/87 can be particularly effectively employed in the processing of the color photographic light-sensitive material of the present invention.

Further, after or in place of the water washing step, a multi-stage countercurrent stabilizing processing step as described in Japanese Patent Application (OPI) No. 8543/82 may be conducted. In this step, two to nine tanks of countercurrent bath is required. To the stabilizing bath various kinds of compounds are added for the purpose of stabilizing images formed. Representative examples of the additives include buffers (for example, borates, metaborates, borax, phosphates, carbonates, potassium hydroxide, sodium hydroxide, aqueous ammonia, monocarboxylic acids, dicarboxylic acids, polycarboxylic acids, etc. being used in combination) for the purpose of adjusting the pH of layers; and formalin, etc. In addition, various additives, for example, water softeners (for example, inorganic phosphoric acids, aminopolycarboxylic acids, organic phosphoric acids, aminopolyphosphonic acids, phosphonocarboxylic acids, etc.), sterilizers (for example, proxel, isothiazolones, 4-thiazolylbenzimidazoles, halogenated phenols, benzotriazoles, etc.), surface active agents, fluorescent whitening agents, hardening agents, etc. may be employed, if desired.

Further, it is preferred to add various ammonium salts such as ammonium chloride, ammonium nitrate, ammonium sulfate, ammonium phosphate, ammonium sulfite, ammonium thiosulfate, etc., as a pH adjusting agent for the layers after processing.

In accordance with the present invention, silver halide color photographic material which can be subjected to rapid processing and which is excellent in processing stability can be provided at a low cost.

The present invention will be explained in greater detail with reference to the following examples, but the present invention should not be construed as being limited thereto.

EXAMPLE 1

On a paper support, both surfaces of which were laminated with polyethylene, were coated layers as shown below in order to prepare a multilayer color printing paper. The coating solution were prepared in the following manner.

Preparation of Coating Solution for First Layer 19.1 g of Yellow Coupler (I-35) and 4.40 g of Color Fading Preventing Agent (Cpd-1) were dissolved in a mixture of 27.2 ml of ethyl acetate and 7.7 ml of Solvent (Solv-1) and the resulting solution was dispersed in 185 ml of a 10% aqueous solution of gelatin containing 8 ml of a 10% aqueous solution of sodium dodecylbenzenesulfonate. Separately, to a silver chlorobromide emulsion (having a bromide content of 80.0 mol % and containing 70 g of silver per kg of the emulsion) was added $5.0\times10^{-4}$ mols of a blue-sensitive sensitizing dye shown below per mol of silver to prepare a blue-sensitive emulsion. The above described emulsified dispersion was mixed with the blue-sensitive silver chlorobromide emulsion, with the concentration of the resulting mixture being controlled, to form the composition shown below, i.e., the coating solution for the first layer.

Coating solutions for the second layer to the seventh layer were prepared in a similar manner as described for the coating solution for the first layer. 1-Oxy-3,5-dichloro-s-triazine sodium salt was used as a gelatin hardener in each layer.

The following spectral sensitizing dyes were employed in the emulsion layers, respectively.

Blue-Sensitive Emulsion Layer:

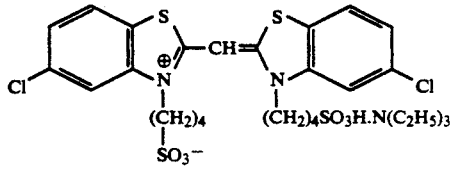

(Amount added: $5.0\times10^{-4}$ mol per mol of silver halide).

Green-Sensitive Emulsion Layer:

-continued

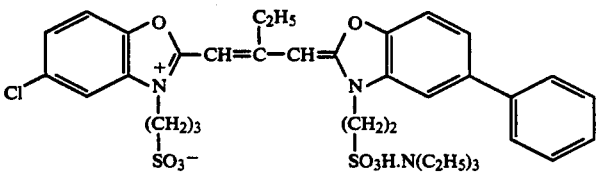

(Amount added: $4.0 \times 10^{-4}$ mol per mol of silver halide).

and

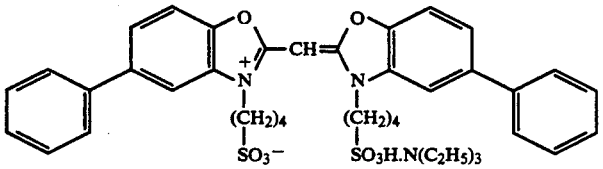

(Amount added: $7.0 \times 10^{-5}$ mol per mol of silver halide).

Red-Sensitive Emulsion Layer:

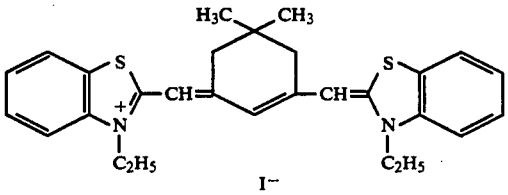

(Amount added: $0.9 \times 10^{-4}$ mol per mol of silver halide).

To the red-sensitive emulsion layer, was added the compound shown below in an amount of $2.6 \times 10^{-3}$ mol per mol of silver halide.

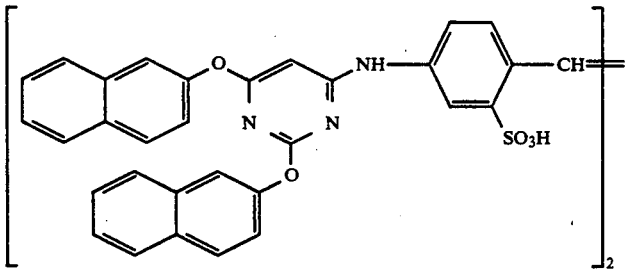

To the blue-sensitive emulsion layer, green-sensitive emulsion layer and red-sensitive emulsion layer, was added 1-(5-methylureidophenyl)-5-mercaptotetrazole in amounts of $4.0 \times 10^{-6}$ mol, $3.0 \times 10^{-5}$ mol and $1.0 \times 10^{-5}$ mol per mol of silver halide, respectively.

Further, to the blue-sensitive emulsion layer and green-sensitive emulsion layer, was added 4-hydroxy-6-methyl- 1,3,3a,7-tetraazaindene in amounts of $1.2 \times 10^{-2}$ mol and $1.1 \times 10^{-2}$ mol per mol of silver halide, respectively.

Moreover, in order to prevent irradiation, the following dyes were added to the emulsion layers.

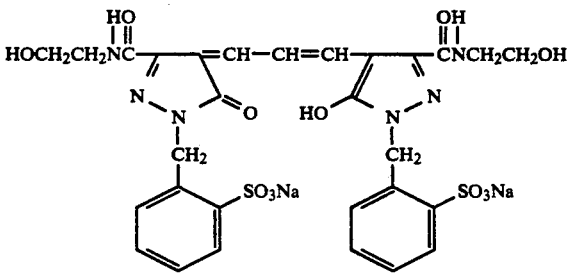

-continued

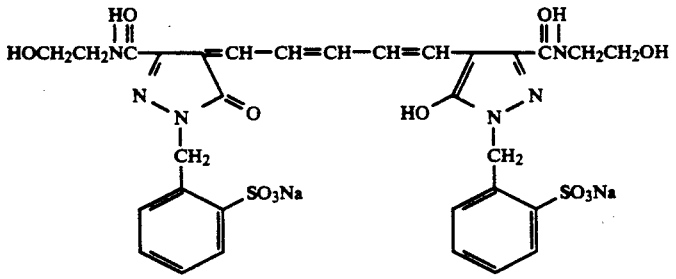

Layer Construction

The composition of each layer is shown below. The numerical value denote the coating amounts of components in the unit of g/m². The coating amount of silver halide emulsion is indicated in terms of silver coating amount.

| | | |
|---|---|---|
| Support | Polyethylene laminated paper (the polyethylene coating containing a white pigment ($TiO_2$) and a bluish dye (ultramarine) on the first layer side) | |
| First layer (Blue-sensitive layer) | Silver Halide Emulsion | 0.35 |
| | Gelatin | 1.83 |
| | Yellow Coupler (I-35) | 0.83 |
| | Color Image Stabilizer (Cpd-1) | 0.19 |
| | Solvent (Solv-1) | 0.35 |
| Second Layer (Color mixing preventing layer) | Gelatin | 0.99 |
| | Color Mixing Preventing Agent (Cpd-2) | 0.08 |
| Third Layer (Green-sensitive layer) | Silver Halide Emulsion (Br: 80%) | 0.16 |
| | Gelatin | 1.79 |
| | Magenta Coupler (ExM-1) | 0.32 |
| | Color Image Stabilizer (Cpd-3) | 0.19 |
| | Anti-Staining Agent (Cpd-4) | 0.02 |
| | Anti-Staining Agent (Cpd-5) | 0.03 |
| | Solvent (Solv-2) | 0.65 |
| Fourth Layer (Ultraviolet light absorbing layer) | Gelatin | 1.58 |
| | Color Mixing Preventing Agent (Cpd-6) | 0.05 |
| | Ultraviolet Light Absorbing Agent (II-11) | 0.26 |
| | Ultraviolet Light Absorbing Agent (II-15) | 0.29 |
| | Ultraviolet Light Absobing Agent (II-16) | 0.07 |
| | Solvent (Solv-1) | 0.24 |
| Fifth Layer (Red-sensitive layer) | Silver Halide Emulsion (Br: 70%) | 0.23 |
| | Gelatin | 1.34 |
| | Cyan Coupler (ExC-1) | 0.33 |
| | Color Image Stabilizer (Cpd-7) | 0.17 |
| | Polymer (Cpd-8) | 0.40 |
| | Solvent (Solv-3) | 0.23 |
| Sixth Layer (Ultraviolet light absorbing layer) | Gelatin | 0.53 |
| | Ultraviolet Light Absorbing Agent (II-11) | 0.09 |
| | Ultraviolet Light Absorbing Agent (II-15) | 0.10 |
| | Ultraviolet Light Absorbing Agent (II-16) | 0.03 |
| | Solvent (Solv-1) | 0.08 |
| Seventh Layer (Protective layer) | Gelatin | 1.33 |
| | Acryl-modified Polyvinyl Alcohol Copolymer (Degree of modification: 17%) | 0.17 |
| | Liquid Paraffin | 0.03 |

The compounds used in the above-described layers have the structures shown below.

(ExM-1) Magenta Coupler:

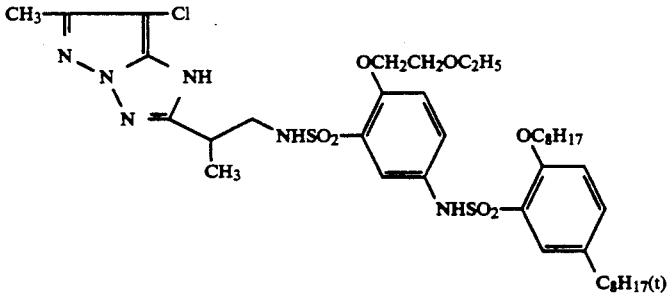

(ExC-1) Cyan Coupler:

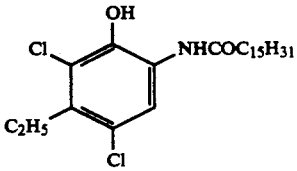

(Cpd-1) Color Image Stabilizer:

-continued
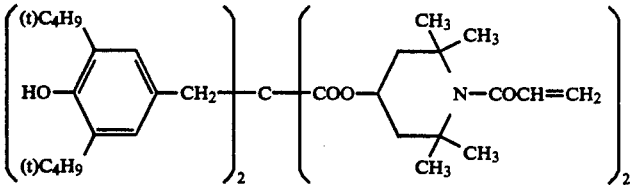
(Cpd-2) Color Mixing Preventing Agent:
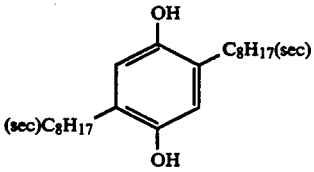
(Cpd-3) Color Image Stabilizer:
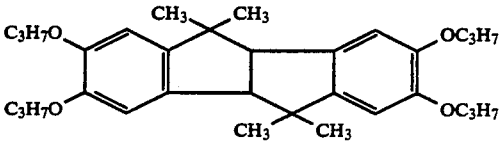
(Cpd-4) Anti-Staining Agent:
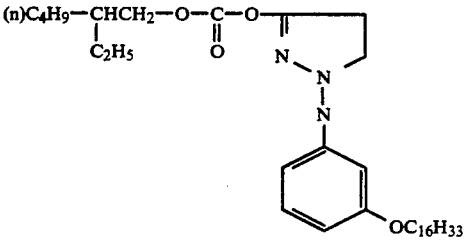
(Cpd-5) Anti-Staining Agent:
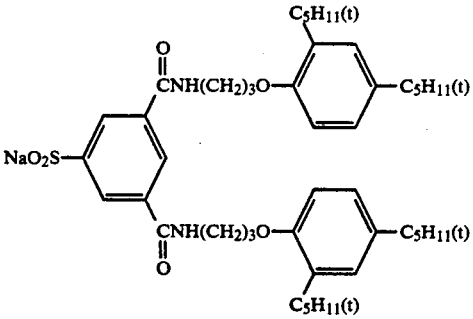
(Cpd-6) Color Mixing Preventing Agent:
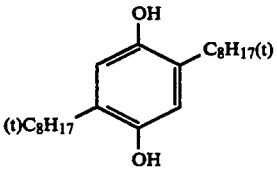
(Cpd-7) A mixture of
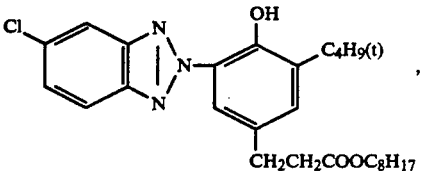

-continued

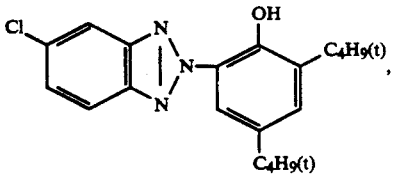

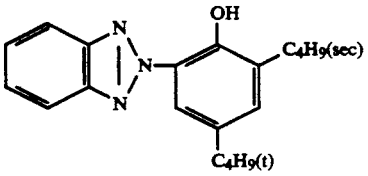

in a weight ratio of 5:8:9.

(Cpd-8) Polymer

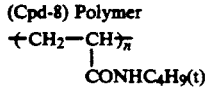

Average Molecular Weight: 80,000

(Solv-1) Solvent

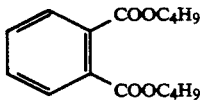

(Solv-2) Solvent

A mixture of

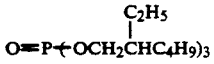

and

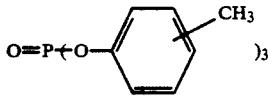

(Solv-3) Solvent

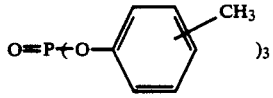

Silver halide emulsion (1) used in the blue-sensitive emulsion layer according to the present invention was prepared in the following manner.

| | |
|---|---|
| Solution 1 | |
| $H_2O$ | 1,000 ml |
| NaCl | 5.5 g |
| Gelatin | 25 g |
| Solution 2 | |
| Sulfuric acid (1N) | 20 ml |
| Solution 3 | |
| A silver halide solvent (1%) of the formula: | 2 ml |

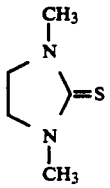

| | |
|---|---|
| Solution 4 | |
| KBr | 2.80 g |

-continued

| | |
|---|---|
| NaCl | 0.34 g |
| $H_2O$ to make | 140 ml |
| Solution 5 | |
| $AgNO_3$ | 5 g |
| $H_2O$ to make | 140 ml |
| Solution 6 | |
| KBr | 67.20 g |
| NaCl | 8.26 g |
| $K_2IrCl_6$ (0.001%) | 0.7 ml |
| $H_2O$ to make | 320 ml |
| Solution 7 | |
| $AgNO_3$ | 120 g |
| $H_2O$ to make | 320 ml |

Solution 1 was heated at 75° C., Solution 2 and Solution 3 were added thereto and then Solution 4 and Solution 5 were added simultaneously over a period of 9 minutes thereto. After 10 minutes, Solution 6 and Solution 7 were added simultaneously over a period of 45 minutes. After 5 minutes, the temperature was dropped and the mixture was de-salted. Water and gelatin for dispersion were added thereto and pH was adjusted to 6.2 whereby a monodispersed cubic silver chlorobromide emulsion (having an average grain size of 1.01 μm, a coefficient of variation [a value obtained by dividing the standard deviation by an average grain size: s/d] 0.08 and a silver bromide content of 80 mol %) was obtained. The emulsion was subjected to optimum chemical sensitization using sodium thiosulfate.

Silver halide emulsion (2) used in the blue-sensitive emulsion layer according to the present invention was prepared in the same manner as described above, except changing the amounts of chemicals, temperature, and time.

Silver halide emulsion (3) used in the blue-sensitive emulsion layer for comparison was prepared in the following manner.

| | | |
|---|---|---|
| Solution 8 | | |
| $H_2O$ | 700 | ml |
| NaCl | 39.4 | g |
| Gelatin | 28 | g |
| Solution 9 | | |
| Sulfuric Acid (1N) | 10 | ml |
| Solution 10 | | |
| KBr | 78.4 | g |
| $K_2IrCl_6$ (0.001%) | 0.7 | ml |
| $H_2O$ to make | 800 | ml |
| Solution 11 | | |
| $AgNO_3$ | 140 | g |
| $H_2O$ to make | 800 | ml |

Solution 8 was heated at 75° C., Solution 9 was added thereto. Then, Solution 10 was added over a period of 40 minutes thereto, and one minute after the beginning of the addition of Solution 10 Solution 11 was added thereto over a period of 40 minutes.

After 5 minutes, the temperature was dropped and the mixture has desalted. Water and gelatin for dispersion were added thereto and pH was adjusted to 6.2 whereby a polydisperse silver chlorobromide (having an average grain size of 0.82 μm, a coefficient of variation of 0.27 and a silver bromide content of 80 mol %) was obtained. The emulsion was subjected to an optimum chemical sensitization using sodium thiosulfate.

Average grain sizes, coefficients of variation and halogen compositions of silver halide emulsion (1), (2) and (3) are shown in Table 1 below.

TABLE 1

| Silver Halide Emulsion | Average Grain Size (μm) | Coefficient of Variation (s/d) | Halogen Composition (%) | |
|---|---|---|---|---|
| (1) (Present Invention) | 1.01 | 0.08 | Br = 80 | Cl = 20 |
| (2) (Present Invention) | 0.80 | 0.07 | Br = 80 | Cl = 20 |
| (3) (Comparison) | 0.82 | 0.27 | Br = 80 | Cl = 20 |

In the above-described layer construction, the silver halide emulsion and the yellow coupler used in the first layer and the solvent used in the fourth layer and the sixth layer were changed as illustrated in Table 2 below, to prepare Samples No. 1 to No. 11.

TABLE 2

| Sample | First Layer | | | Fourth Layer and Sixth Layer | |
|---|---|---|---|---|---|
| No. | Emulsion | Silver Amount | Coupler | Solvent | Relative Refractive Index |
| 1 | (3) | 0.35 | I-35 | Solv-1 | 1.021 |
| 2 | (3) | 0.35 | I-35 | Solv-3 | 1.035 |
| 3 | (2) | 0.26 | I-35 | Solv-1 | 1.021 |
| 4 | (2) | 0.26 | I-35 | O-3 | 1.008 |
| 5 | (2) | 0.26 | I-35 | O-12 | 1.009 |
| 6 | (2) | 0.26 | I-35 | O-25 | 1.011 |
| 7 | (1) + (2) | 0.26 | I-35 | O-25 | 0:011 |
| 8 | (1) + (2) | 0.26 | I-36 | O-25 | 1.011 |
| 9 | (1) + (2) | 0.26 | I-23 | O-25 | 1.011 |
| 10 | (1) + (2) | 0.26 | I-23 | O-37 | 1.012 |
| 11 | (1) + (2) | 0.26 | I-23 | O-38 | 1.004 |

Notes (1) The emulsion used in Samples No. 7 to No. 11 is a mixture of Emulsion (1) and Emulsion (2) in a ratio of 4:6 by weight.

(2) The silver amount denotes a coating amount of silver in the unit of $g/m^2$.

(3) The relative refractive index means a relative value of a refractive index of an organic phase containing the hydrophobic compound represented by the general formula (II) with the exception of a volatile organic solvent and an amphipatic solute to a hydrophilic polymer thin film.

Samples No. 1 to No. 11 were wedgewise exposed for sensitometry through a three-color separation filter using a sensitometer (FWH type, manufactured by Fuji Photo Film Co., Ltd.) equipped with a light source of color temperature 3200° K. The amount of exposure was 250 CMS for an exposure time of 0.1 second. Then, the samples were subjected to development processing according to Processing Step (A) shown below. Further, another processing wherein the developing time was shortened from the standard processing time of 3 minutes and 30 seconds to 2 minutes and 30 seconds was conducted. From the sensitivities and maximum color densities ($D_{max}$) thus-obtained, a rapid processing ability was evaluated. The sensitivity was shown using a relative value to the sensitivity of Sample No. 1 processed at the developing time of 3 minutes and 30 seconds.

Moreover, in order to evaluate the processing stability, Processing Step (B) wherein the amount of potassium bromide in the color developing solution used in Processing Step (A) respectivily were determined.

The results thus-obtained are shown in Table 3 below.

| Processing Step (A): | | |
|---|---|---|
| Processing Step | Temperature | Time |
| Color Development | 33° C. | 3 min 30 sec |
| Bleach-Fixing | 33° C. | 1 min 30 sec |
| Washing with Water | 24 to 34° C. | 3 min |
| Drying | 70 to 80° C. | 1 min |

The composition of each processing solution used was as follows.

| Color Developing Solution: | |
|---|---|
| Water | 800 ml |
| Diethylenetriaminepentaacetic acid | 1.0 g |
| Nitrilotriacetic acid | 1.5 g |
| Benzyl alcohol | 15 ml |
| Diethylene glycol | 10 ml |
| Sodium sulfite | 2.0 g |
| Potassium bromide | 0.5 g |
| Potassium carbonate | 30 g |
| N-Ethyl-N-(β-methanesulfonamidoethyl)-3-methyl-4-aminoaniline sulfate | 5.0 g |
| Hydroxylamine sulfate | 4.0 g |
| Fluorescent brightening agent (WHITEX 4B manufactured by Sumitomo Chemical Co., Ltd.) | 1.0 g |
| Water to make | 1000 ml |
| pH (25° C.) | 10.20 |
| **Bleach-Fixing Solution:** | |
| Water | 400 ml |
| Ammonium thiosulfate (70%) | 150 ml |
| Sodium sulfite | 18 g |

-continued

| | |
|---|---|
| Iron (III) ammonium ethylenediamine-tetraacetate | 55 g |
| Disodium ethylenediaminetetraacetate | 5 g |
| Water to make | 1000 ml |
| pH (25° C.) | 6.70 |

TBLE 3

| Sample No. | Processing for 2 min 30 sec Sensitivity | Dmax | Processing for 3 min 30 sec Sensitivity | Dmax | Change in Density ΔD1.5 | ΔD1.5 |
|---|---|---|---|---|---|---|
| 1 | 76 | 1.85 | 100 | 1.99 | −0.28 | −0.30 |
| 2 | 75 | 1.84 | 101 | 1.98 | −0.28 | −0.30 |
| 3 | 85 | 1.85 | 100 | 1.95 | −0.12 | −0.13 |
| 4 | 90 | 2.02 | 99 | 2.15 | −0.12 | −0.12 |
| 5 | 91 | 2.01 | 100 | 2.14 | −0.12 | −0.13 |
| 6 | 92 | 2.00 | 101 | 2.12 | −0.13 | −0.13 |
| 7 | 133 | 1.99 | 145 | 2.12 | −0.16 | −0.16 |
| 8 | 134 | 2.01 | 144 | 2.14 | −0.16 | −0.16 |
| 9 | 135 | 2.03 | 145 | 2.15 | −0.16 | −0.16 |
| 10 | 135 | 2.02 | 144 | 2.15 | −0.16 | −0.16 |
| 11 | 134 | 2.05 | 144 | 2.18 | −0.16 | −0.16 |

From the results shown in Table 3, it can be seen that Samples No. 4 to No. 11 according to the present invention had sufficiently high color forming property in the processing of 2 min 30 sec in spite of a reduced amount of coated silver, and that they exhibited little change in density depending on the change in the amount of potassium bromide in the color developing solution. Thus, they were excellent in processing stability.

EXAMPLE 2

A multilayer color printing paper was prepared in the same manner as described in Example 1 except that the irradiation preventing dyes, the third layer, the fourth layer, the fifth layer and the sixth layer was changed to those shown below.

Irradiation Preventing Dye:

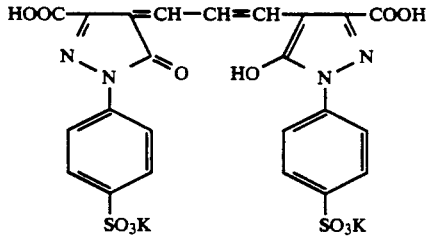

and

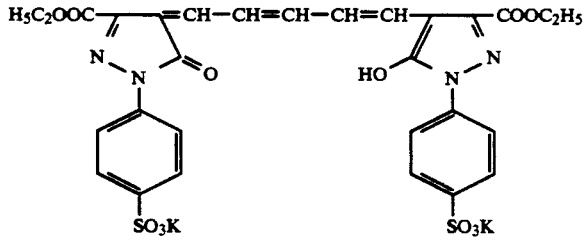

| | | |
|---|---|---|
| Third Layer (Green-sensitive layer) | Silver Halide Emulsion (Br: 80%) | 0.19 |
| | Gelatin | 1.23 |
| | Magenta Coupler (ExM-2) | 0.28 |
| | Color Image Stabilizer (Cpd-3) | 0.08 |
| | Color Image Stabilizer (Cpd-9) | 0.06 |
| | Anti-Staining Agent (Cpd-10) | 0.15 |
| | Solvent (Solv-4) | 0.27 |
| Fourth Layer (Ultraviolet light absorbing layer) | Gelatin | 1.58 |
| | Color Mixing Preventing Agent (Cpd-6) | 0.05 |
| | Ultraviolet Light Absorbing Agent (II-1) | 0.07 |

-continued

| | | |
|---|---|---|
| | Ultraviolet Light Absorbing Agent (II-3) | 0.30 |
| | Ultraviolet Light Absorbing Agent (II-15) | 0.25 |
| | Solvent (Solv-1) | 0.24 |
| Fifth Layer | Silver Halide Emulsion (Br: 70%) | 0.23 |
| (Red-sensitive layer) | Gelatin | 1.34 |
| | Cyan Coupler (ExC-2) | 0.17 |
| | Cyan Coupler (ExC-3) | 0.21 |
| | Color Image Stabilizer (Cpd-7) | 0.17 |
| | Solvent (Solv-1) | 0.23 |
| Sixth Layer | Gelatin | 0.53 |
| (Ultraviolet light absorbing layer) | Ultraviolet Light Absorbing Agent (II-1) | 0.02 |
| | Ultraviolet Light Absorbing Agent (II-3) | 0.10 |
| | Ultraviolet Light Absorbing Agent (II-15) | 0.08 |
| | Solvent (Solv-1) | 0.08 |

The compounds used in the above-described layers have the structures shown below respectively.

(ExM-2) Magenta Coupler:

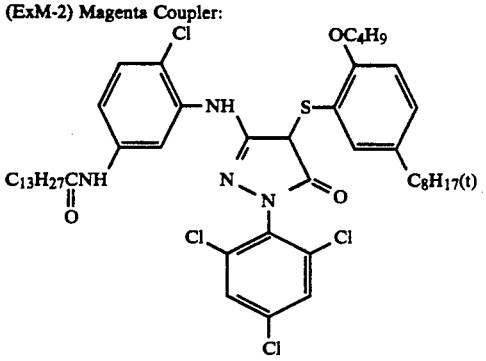

(ExC-2) Cyan Coupler:

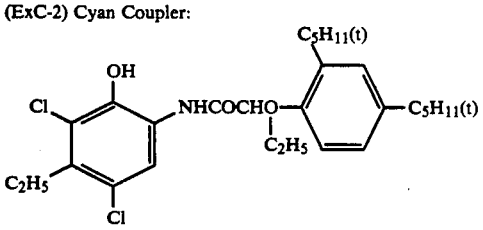

(ExC-3) Cyan Coupler:

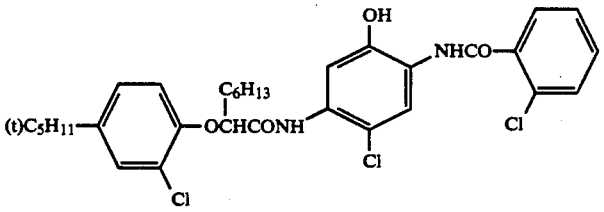

(Cpd-9) Color Image Stabilizer:

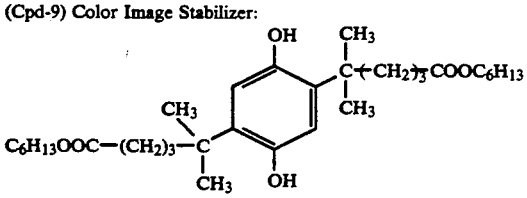

(Cpd-10) Anti-Staining Agent:

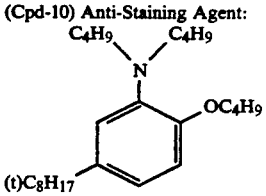

-continued (Solv-4) Solvent
A mixture of

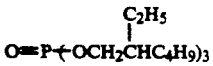

and

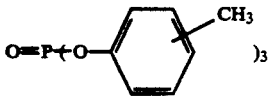

in a volume ratio 1:2.

In the same manner as described in Example 1, the silver halide emulsion and the yellow coupler used in the first layer and the solvent used in the fourth layer and the sixth layer were changed to prepare Samples No. 12 to No. 22. These samples were evaluated in the same manner as described in Example 1, and similar results were obtained.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a reflective support having provided thereon a blue-sensitive silver halide emulsion layer, a green-sensitive silver halide emulsion layer, a red-sensitive silver halide emulsion layer and plural light-insensitive layers, wherein the blue-sensitive silver halide emulsion layer contains a monodisperse silver halide emulsion and a yellow coupler represented by formula (I) defined below, and at least one light-insensitive layer which is positioned farther from the reflective support than the blue-sensitive silver halide emulsion layer is a hydrophilic colloid layer containing at least one hydrophobic compound represented by formula (II) defined below, and a relative refractive index of an organic phase containing the hydrophobic compound with the exception of a volatile organic solvent and an amphipathic solute to a hydrophilic polymer thin film which forms the light-insensitive layer is from 0.9875 to 1.0125;

wherein said yellow coupler is represented by formula (I)

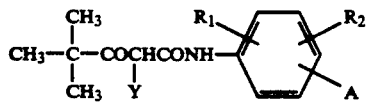

(I)

wherein $R_1$ represents a halogen atom or an alkoxy group; $R_2$ represents a hydrogen atom, a halogen atom or an alkoxy group; A represents —NHCOR$_3$, —NHSO$_2$R$_3$, —SO$_2$NHR$_3$, —COOR$_3$ or

—SO$_2$NR$_3$; (R$_4$)

$R_3$ and $R_4$ each represents an alkyl group; and Y represents a group which is capable of being released upon a coupling reaction with an oxidation product of a developing agent and is connected to the coupling position through an oxygen atom or a nitrogen atom;

wherein said hydrophobic compound is represented by formula (II)

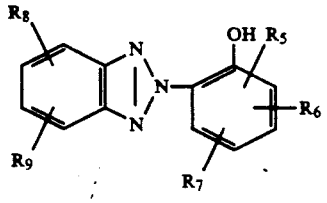

(II)

wherein $R_5$, $R_6$, $R_7$, $R_8$, and $R_9$ each represents a hydrogen atom, a halogen atom, a nitro group, a hydroxy group, an alkyl group, an alkenyl group, an alkylthio group, an arylthio group, a mono- or di-alkylamino group, an acylamino group or a 5-membered or 6-membered heterocyclic group containing an oxygen atom or a nitrogen atom; or $R_8$ and $R_9$ are connected together to form a 5-membered or 6-membered aromatic carbon ring, and wherein the hydrophobic colloid layer containing at least one hydrophobic compound represented by formula (II) further contains a non-volatile organic solvent having a boiling point of 175° C. or more and having a refractive index of less than 1.46, which solvent is selected from an ester of citric acid, an ester of fatty acid, an ester of carbonic acid, an amide, and an ester or ether of a fluorine-containing alcohol.

2. A silver halide color photographic material as in claim 1, wherein the monodisperse silver halide emulsion used in the blue-sensitive silver halide emulsion layer has an average particle size from 0.2 μm to 2 μm defined as a diameter of a circle having an area equal to the projected area of the grain, and a coefficient of variation of not more than 0.2.

3. A silver halide color photographic material as in claim 1, wherein the monodisperse silver halide emulsion used in the blue-sensitive silver halide emulsion layer is composed of silver chlorobromide containing substantially no silver iodide and from 2 mol % to 80 mol % of silver chloride.

4. A silver halide color photographic material as in claim 1, wherein the alkoxy group represented by $R_2$ or the alkyl group represented by $R_3$ or $R_4$ may be substituted with one or more substituents selected from an alkyl group, an aryl group, a heterocyclic group, an alkoxy group, an aryloxy group, an alkenyloxy group, an acyl group, an ester group, an amido group, a carbamoyl group, a sulfamoyl group, an imido group, a ureido group, an aliphatic or aromatic sulfonyl group, an aliphatic or aromatic thio group, a hydroxy group, a cyano group, a carboxy group, a nitro group, a sulfo group, and a halogen atom.

5. A silver halide color photographic material as in claim 1, wherein the group capable of being released represented by Y is a group represented by formula (III), (IV), (V), or (VI)

$$-OR_{10} \quad \text{(III)}$$

wherein $R_{10}$ represents an unsubstituted or substituted aryl group or heterocyclic group, (IV)

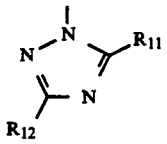

(V)

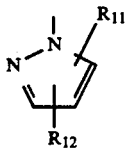

wherein $R_{11}$ and $R_{12}$ each represents a hydrogen atom, a halogen atom, a carboxylic acid ester group, an amino group, an alkyl group, an alkylthio group, an alkoxy group, an alkylsulfonyl group, an alkylsulfinyl group, a carboxylic acid group, a sulfonic acid group, an unsubstituted or substituted phenyl group or an unsubstituted or substituted heterocyclic group, (VI)

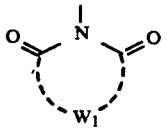

wherein $W_1$ represents non-metallic atoms necessary for forming a 4-membered, 5-membered, or 6-membered ring together with the

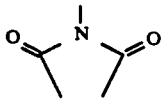

portion of formula (VI).

6. A silver halide color photographic material as in claim 5, wherein the group represented by formula (VI) is a group represented by formula (VII), (VIII), or (IX)

(VII)

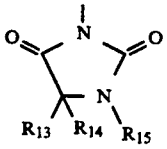

-continued (VIII)

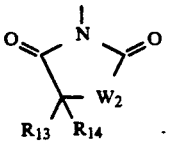

(IX)

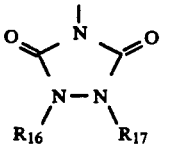

wherein $R_{13}$ and $R_{14}$ each represents a hydrogen atom, an alkyl group, an aryl group, an alkoxy group, an aryloxy group, or a hydroxy group; $R_{15}$, $R_{16}$ and $R_{17}$ each represents a hydrogen atom, an alkyl group, an aryl group, an aralkyl group or an acyl group; and $W_2$ represents an oxygen atom or sulfur atom.

7. The silver halide color photographic material of claim 1, wherein said non-volatile organic solvent is selected from O-10 to O-43

(O-10)

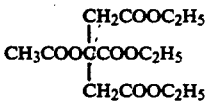

(O-11)

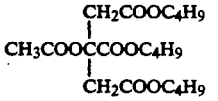

(O-12)

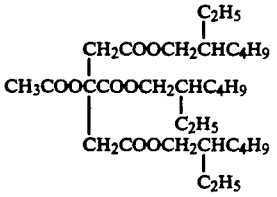

(O-13)

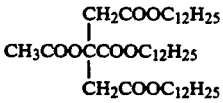

(O-14)

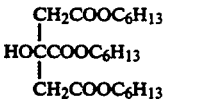

(O-15)

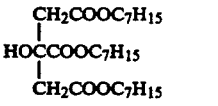

(O-16)

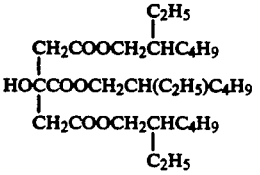

(O-17)

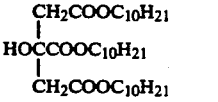

-continued $CH_2COOC_9H_{19}$-iso
|
$HOCCOOC_9H_{19}$-iso
|
$CH_2COOC_9H_{19}$-iso (O-18)

$CH_2COOC_{18}H_{37}$(iso)
|
$HOCHCOOC_{18}H_{37}$(iso) (O-19)

$C_{17}H_{33}COOCH_3$ (O-20)

$CH_2COOC_4H_9$
|
$CH_2COOC_4H_9$ (O-21)

$COOCH_2CHC_4H_9$
|  |
$(CH_2)_4$  $C_2H_5$
|
$COOCH_2CHC_4H_9$
|
$C_2H_5$ (O-22)

$COOCH_2(C_2H_5)C_4H_9$
|
$(CH_2)_7$
|
$COOCH_2(C_2H_5)C_4H_9$ (O-23)

$COOC_4H_9$
|
$(CH_2)_8$
|
$COOC_4H_9$ (O-24)

$COOCH_2CHC_4H_9$
|  |
$(CH_2)_8$  $C_2H_5$
|
$COOCH_2CHC_4H_9$
|
$C_2H_5$ (O-25)

$OCOCH_3$
|
$(CH_2)_{10}$
|
$OCOCH_3$ (O-26)

$CH_2OCOC_{17}H_{35}$
|
$CHOCOCH_3$
|
$CH_2OCOCH_3$ (O-27)

$CH_2COOC_4H_9$
|
$CHCOOC_4H_9$
|
$CH_2COOC_4H_9$ (O-28)

$COOC_4H_9$
|
$(CHOCOCH_3)_2$
|
$COOC_4H_9$ (O-29)

$C_{13}H_{27}COOC_{18}H_{37}$-iso (O-30)

$C_{13}H_{27}COOCH_2CHC_8H_{17}$
|
$C_6H_{13}$ (O-31)

$C_8H_{17}OCOOC_8H_{17}$ (O-32)

$C_{12}H_{25}OCOC_{12}H_{25}$
||
O (O-33)

$C_7H_{15}CON(CH_3)_2$ (O-34)

$C_7H_{15}CON(C_2H_5)_2$ (O-35)

$C_{11}H_{23}CON(CH_3)_2$ (O-36)

-continued $C_{11}H_{23}CON(C_2H_5)_2$ (O-37)

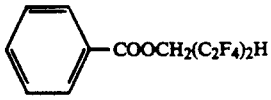

(O-38)

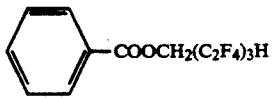

(O-39)

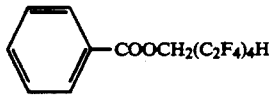

(O-40)

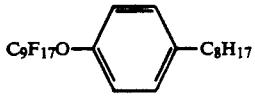

(O-41)

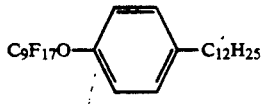

(O-42)

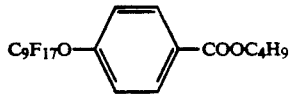

(O-43)

8. A silver halide color photographic material as in claim 1, wherein the hydrophobic compound represented by formula (II) is a compound represented by formula (X),

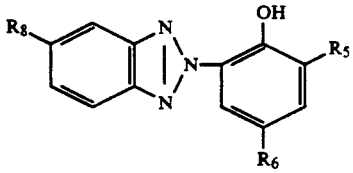

(X)

wherein $R_5$ and $R_6$ each has the same meaning as defined for formula (II); and $R_8$ represents a hydrogen atom, a halogen atom, an alkyl group, an alkoxy group, an aryl group or an aryloxy group, each having the same meaning as defined for formula (II).

9. A silver halide color photographic material as in claim 8, wherein $R_8$ is a halogen atom.

10. A silver halide color photographic material as in claim 1, wherein the hydrophobic compound is selected from the group consisting of compounds of formulae (II-3) to (II-10), (II-12) to (II-14), and (II-16) to (II-30)

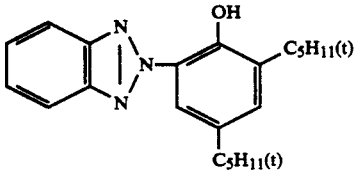

(II-3)

-continued
(II-4)
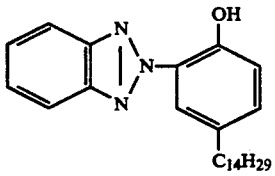
(II-5)
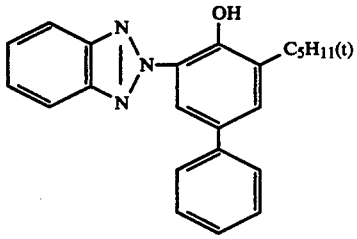
(II-6)
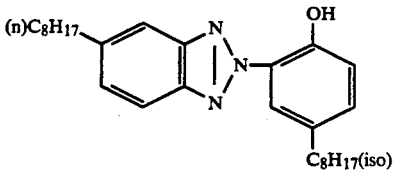
(II-7)
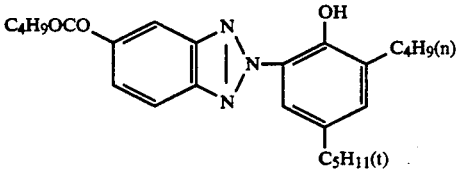
(II-8)
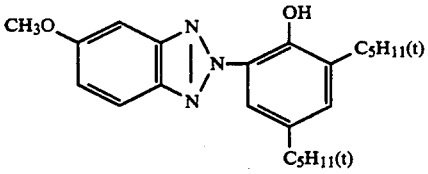
(II-9)
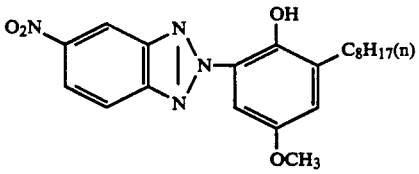
(II-10)
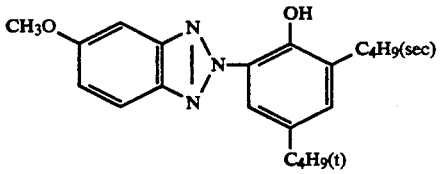
(II-12)
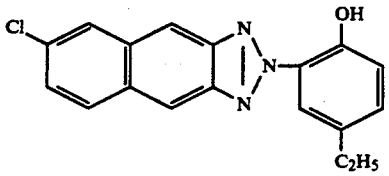
-continued
(II-13)
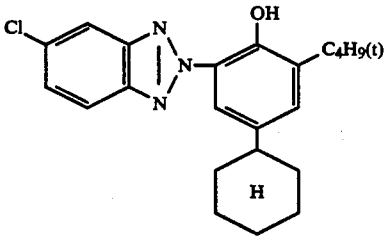
(II-14)
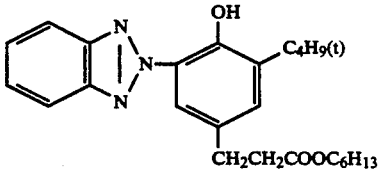
(II-16)
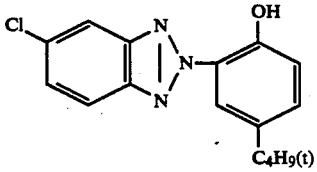
(II-17)
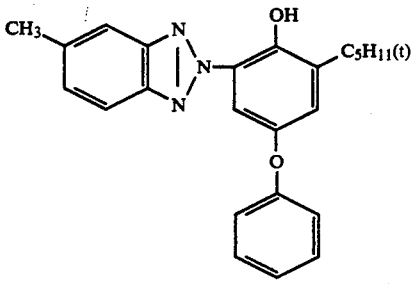
(II-18)
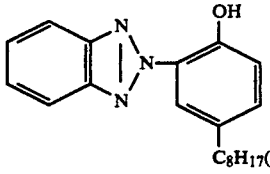
(II-19)
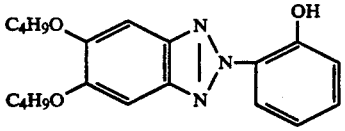
(II-20)
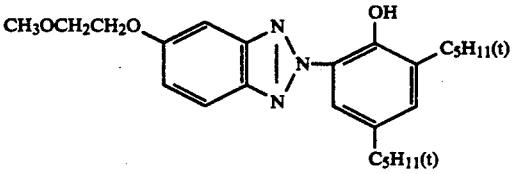
(II-21)
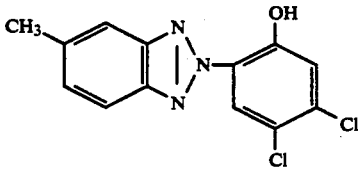

-continued

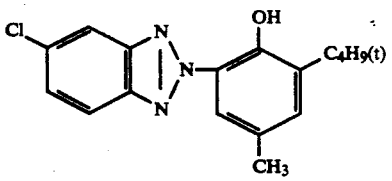
(II-22)

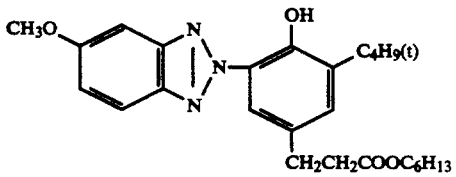
(II-23)

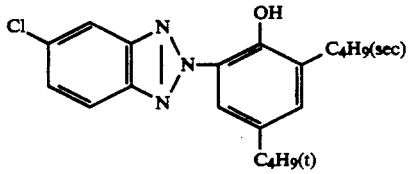
(II-24)

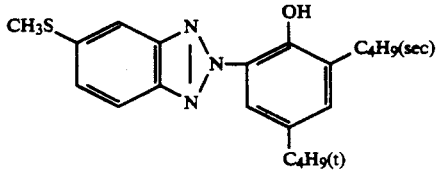
(II-25)

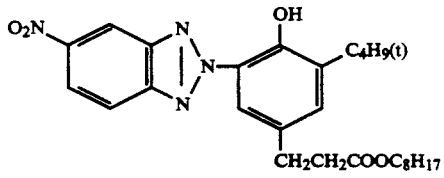
(II-26)

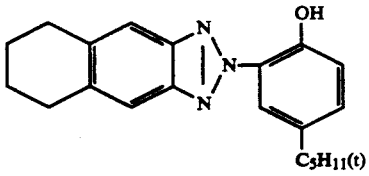
(II-27)

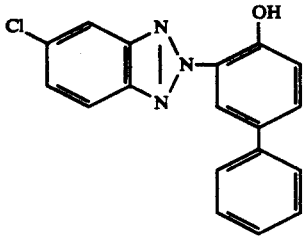
(II-28)

-continued

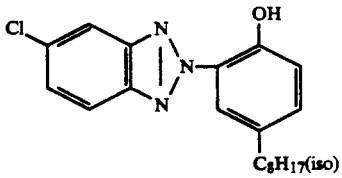
(II-29)

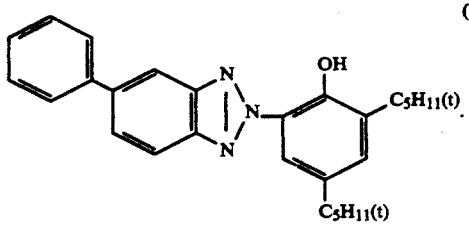
(II-30)

11. A silver halide color photographic material as in claim 1, wherein the hydrophobic compound is selected from the group consisting of compounds of formula (II-1) to (II-2) and (II-11):

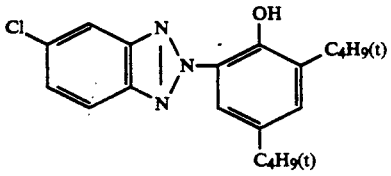
(II-1)

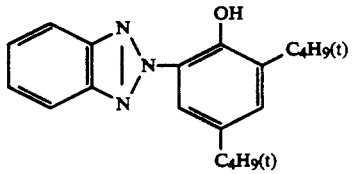
(II-2)

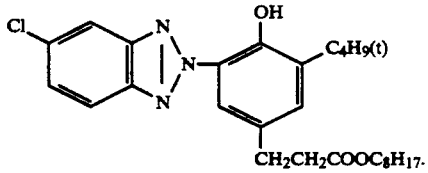
(II-11)

12. A silver halide color photographic material as in claim 1, wherein the amount of the yellow coupler represented by formula (I) is in a range from 0.3 g/m$^2$ to 1.5 g/m$^2$.

13. A silver halide color photographic material as in claim 1, wherein the amount of the hydrophobic compound represented by formula (II) is in a range from 0.3 g/m$^2$ to 1.2 g/m$^2$.

14. A silver halide color photographic material as in claim 9, wherein the amount of the non-volatile organic solvent is from 0.1 ml/m$^2$ to 0.8 ml/m$^2$.

15. A silver halide color photographic material as in claim 1, wherein green-sensitive silver halide emulsion layer and the red-sensitive silver halide emulsion layer contain a magenta coupler and a cyan coupler, respectively.

16. A silver halide color photographic material as in claim 15, wherein the magenta coupler is a 5-pyrazolone type coupler or a pyrazoloazole type coupler.

17. A silver halide color photographic material as in claim 15, wherein the cyan coupler is a naphthyl type coupler or a phenyl type coupler.

* * * * *